US012305504B2

(12) United States Patent
Chang et al.

(10) Patent No.: US 12,305,504 B2
(45) **Date of Patent: *May 20, 2025**

(54) QUANTIFYING ZONAL FLOW IN MULTI-LATERAL WELLS VIA TAGGANTS OF FLUIDS

(71) Applicant: Saudi Arabian Oil Company, Dhahran (SA)

(72) Inventors: Sehoon Chang, Boston, MA (US); Wei Wang, Quincy, MA (US); Bora Yoon, Watertown, MA (US)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 18/490,507

(22) Filed: Oct. 19, 2023

(65) Prior Publication Data

US 2025/0129711 A1 Apr. 24, 2025

(51) Int. Cl.
*E21B 47/11* (2012.01)
*E21B 41/00* (2006.01)

(52) U.S. Cl.
CPC ..... *E21B 47/11* (2020.05); *E21B 41/0035* (2013.01)

(58) Field of Classification Search
CPC ..... E21B 34/06; E21B 47/11; E21B 47/111
USPC ..... 166/250.12
See application file for complete search history.

(56) References Cited

U.S. PATENT DOCUMENTS 3,623,842 A 11/1971 Deans
4,558,219 A 12/1985 LeBlanc et al.
5,608,214 A * 3/1997 Baron ..... G01V 5/12 250/269.3
6,659,175 B2 12/2003 Malone et al.
7,560,690 B2 7/2009 Stray et al.
8,949,029 B2 2/2015 Nyhavn
9,133,683 B2 9/2015 Dyer et al.
9,284,833 B2 3/2016 Hewitt et al.
9,290,689 B2 * 3/2016 Lafitte ..... E21B 47/11
(Continued)

FOREIGN PATENT DOCUMENTS

CN 111764881 A * 10/2020
GB 2528716 2/2016
(Continued)

OTHER PUBLICATIONS

English Translation of CN-111764881-A (Year: 2020).*
(Continued)

*Primary Examiner* — Angela M DiTrani Leff
(74) *Attorney, Agent, or Firm* — Fish & Richardson P.C.

(57) ABSTRACT

A method of quantifying zonal flow in a multi-lateral well is described. A first taggant is flowed to a first lateral, and a second taggant is flowed to a second lateral. A first produced fluid that includes the first taggant is flowed from the first lateral into a production tubing. A second produced fluid that includes the second taggant is flowed from the second lateral into the production tubing. A produced stream including the first produced fluid and the second produced fluid is flowed uphole through the production tubing. An amount of the first taggant and an amount of the second taggant in the produced stream are measured. Production of fluid from the multi-lateral well proceeds without ceasing throughout the method.

20 Claims, 19 Drawing Sheets

(56) References Cited

U.S. PATENT DOCUMENTS

| | | | | |
|---|---|---|---|---|
| 9,910,026 | B2 | 3/2018 | Zhang et al. | |
| 10,669,839 | B2 | 6/2020 | Nyhavn | |
| 10,815,775 | B2 * | 10/2020 | Lauritzen | E21B 27/02 |
| 10,871,067 | B2 | 12/2020 | Nyhavn | |
| 11,773,715 | B2 | 10/2023 | Poitzsch et al. | |
| 2007/0241277 | A1 * | 10/2007 | Stray | E21B 47/11 250/303 |
| 2007/0289740 | A1 * | 12/2007 | Thigpen | E21B 37/06 166/250.01 |
| 2011/0239754 | A1 | 10/2011 | Dyer et al. | |
| 2011/0240287 | A1 * | 10/2011 | Hartshorne | E21B 47/11 166/250.12 |
| 2011/0257887 | A1 | 10/2011 | Cooper et al. | |
| 2014/0299756 | A1 | 10/2014 | Cameron | |
| 2015/0130468 | A1 * | 5/2015 | Christian | E21B 47/11 324/324 |
| 2015/0192008 | A1 | 7/2015 | Dikshit et al. | |
| 2016/0010454 | A1 | 1/2016 | Sira et al. | |
| 2017/0097443 | A1 * | 4/2017 | Bernstein | G01N 23/223 |
| 2018/0275114 | A1 | 9/2018 | Kosynkin et al. | |
| 2018/0282605 | A1 * | 10/2018 | Borrell | C09K 8/58 |
| 2018/0298274 | A1 | 10/2018 | Zhao | |
| 2019/0382652 | A1 * | 12/2019 | Brierley | C09K 8/70 |
| 2020/0032641 | A1 | 1/2020 | Kulyakhtin et al. | |
| 2021/0332695 | A1 | 10/2021 | Shaw | |
| 2022/0056329 | A1 | 2/2022 | AlJabri | |
| 2022/0065101 | A1 | 3/2022 | Poitzsch et al. | |
| 2022/0162927 | A1 * | 5/2022 | Rowaihy | E21B 33/124 |
| 2023/0193755 | A1 * | 6/2023 | Chen | E21B 43/12 166/250.12 |

FOREIGN PATENT DOCUMENTS

| | | |
|---|---|---|
| GB | 2569868 | 7/2019 |
| NO | 20140495 | 6/2014 |
| WO | WO 2012057634 | 5/2012 |
| WO | WO 2014104914 | 7/2014 |
| WO | WO 2016105210 | 6/2016 |
| WO | WO 2019066811 | 4/2019 |
| WO | WO 2020239649 | 12/2020 |

OTHER PUBLICATIONS

Aggrey et al., "A Novel Approach of Detecting Water Influx Time in Multi-Zone and Multilateral Completions Using Real-Time Downhole Pressure Data," presented at the SPE Middle East Oil and Gas Show and Conference, Manama, Bahrain, Mar. 11-14, 2007, 11 pages.

Anderson et al., "Interventionless Surveillance in a Multi-Lateral Horizontal Well," IADC/SPE Drilling Conference and Exhibition, held in San Diego, California, United States, Mar. 6-8, 2012, 9 pages.

Anopov et al., "Permanent Downhole Chemical Tracer System for Wireless Surveillance and Optimizing Well Production," presented at the SPE/IADC Middle East Drilling Technology Conference and Exhibition, Abu Dhabi, UAE, Jan. 31, 2018, 13 pages.

Chen et al., "Optimization of Tracer Injection Schemes for Improved History Matching," SPE-206142-MS, OnePetro, Sep. 2021, 9 pages.

Chen et al., "Upconversion Nanoparticles: Design, Nanochemistry, and Applications in Theranostics," Chemical Reviews, Mar. 2014, 114(10):5161-5214, 101 pages.

Dyer et al., "Technology Update: New Intelligent Completion System Enables Compartment-Level Control in Multilateral Wells," Journal of Petroleum Technology, 68 (9): 18-21, 3 pages.

Dyril et al., "Ten Years of Reservoir Monitoring with Chemical Inflow Tracers—What Have We Learnt and Applied Over the Past Decade?" SPE-187677-MS, Kuwait Oil & Gas Show and Conference, held in Kuwait City, Kuwait, Oct. 2017, 22 pages.

Hu "Utilizing Oil-soluble Tracers to Evaluate the Production Profile in Multistage Fractured Horizontal Wells," for the degree of Master of Applied Science, University of Regina, Dec. 2019, 186 pages.

Isoppo et al., "Highly Fluorescent Lipophilic 2,1,3-Benzothiadiazole Fluorophores as Optical Sensors for Tagging Material and Gasoline Adulteration with Ethanol," Sensors and Actuators B: Chemical, Apr. 2020, 35 pages.

Jose et al., "Benzophenoxazine-based fluorescent dyes for labeling biomolecules," Tetrahedron, Nov. 2006, 62(48):11021-11037, 17 pages.

Joubran, "Intelligent Completions: Design and Reliability of Interval Control Valves in the Past, Present, and Future," OTC-28917-MS, Offshore Technology Conference, held in Houston, Texas, United States, Apr. 2018, 29 pages.

Li et al., "Evaluation of the Release Mechanism of Sustained-Release Tracers and its Application in Horizontal Well Inflow Profile Monitoring," ASC Omega, 2021, 6:19269-19280, 12 pages.

Muradov et al., "Zonal Rate Allocation in Intelligent Wells," SPE 121055, EUROPEC/EAGE Conference and Exhibition, held in Amsterdam, The Netherlands, Jun. 2009, 13 pages.

Oftedal et al., "Permanent Chemical Tracers Piloted for Inflow Monitoring in Cemented Production Liner," OTC-26946-MS, Offshore Tech. Conf., held in Houston, Texas, United States, May 2016, 15 pages.

Ow et al., "Automatable High Sensitivity Tracer Detection: Toward Tracer Data Enriched Production Management of Hydrocarbon Reservoirs," presented at the SPE Annual Technical Conference and Exhibition, Dubai, UAE, Sep. 22, 2021, 10 pages.

Ow, et al., "First Deployment of a Novel Advanced Tracers System for Improved Waterflood Recovery Optimization ," SPE-192598, Society of Petroleum Engineers, Nov. 2018, 10 pages.

pubchem.ncbi.nlm.nih.gov [online], "2-(2-Ethylhexyl)-6,7-dimethoxy-1H-benz[de]isoquinoline-1,3(2H)-dione," available on or before Mar. 6, 2024, via Internet Archive: Wayback Machine URL <https://web.archive.org/web/20240306211042/https://pubchem.ncbi.nlm.nih.gov/compound/92025#section=2D-Structure>, retrieved on Mar. 6, 2024, 12 pages.

pubchem.ncbi.nlm.nih.gov [online], "Bis(2-methylpropyl) 4, 10-dicyanoperylene-3,9-dicarboxylate," available on or before Mar. 6, 2024, via Internet Archive: Wayback Machine URL <https://web.archive.org/web/20240306210457/https://pubchem.ncbi.nlm.nih.gov/compound/13750327>, retrieved on Mar. 6, 2024, 15 pages.

pubchem.ncbi.nlm.nih.gov [online], "Perylene Red," available on or before Mar. 6, 2024, via Internet Archive: Wayback Machine URL <https://web.archive.org/web/20240306211744/https://pubchem.ncbi.nlm.nih.gov/compound/16172388#section=Deprecated-CAS>, retrieved on Mar. 6, 2024, 16 pages.

Salimov et al., "Allocation Of Zonal Production In Smart Wells: Offshore Abu-Dhabi Case Study," SPE-188416-MS, Abu Dhabi International Petroleum Exhibition & Conference, held in Abu Dhabi, UAE, Nov. 2017, 11 pages.

SLB, Downhole Interval Control Valves, retrieved Mar. 29, 2024 from https://www.slb.com/products-and-services/U innovating-in-oil-and-gas/completions/well-completions/intelligent-completions/downhole-interval-control-valves#:~:text=Interval%20or%20flow%20control%20valves,interventions%2C%20and%20maximize%20 (Year: 2024).

Thomas et al., "Deployment and Detection of a Novel Barcoded Advanced Tracers System for the Optimization of Improved Waterflood Recovery in Hydrocarbon Reservoirs," presented at the SPE Middle East Oil and Gas Show and Conference, Manama, Bahrain, Mar. 20, 2019, 10 pages.

Williams et al., "Wireless Reservoir Surveillance Using Intelligent Tracers," OTC 23282, Offshore Technology Conference, held in Houston, Texas, United States, Apr.-May 2012, 11 pages.

Zhou et al., "Upconversion Luminescent Materials: Advances and Applications," Chemical Reviews, Dec. 2014, 115(1):395-465, 71 pages.

U.S. Appl. No. 18/182,235, Yoon et al., Quantifying Zonal Flow In Multi-Lateral Wells Via Taggants of Fluids, filed Mar. 10, 2023, 98 pages.

U.S. Appl. No. 18/317,335, Thomas et al., Analyzing Hydrocarbon Flow into Multi-Lateral Wells by Releasing Tracers from the Surface, filed May 15, 2023, 27 pages.

* cited by examiner

300

400

500

Sm Standards
Std. Dev. σ = 2.7 ppm
Squ. Corel Coeff. $R^2$ = 0.99463

Tb Standards
Std. Dev. σ = 3.1 ppm
Squ. Corel Coeff. $R^2$ = 0.99511

Sm in Crude Oil
Std. Dev. σ = 6.8 ppm
Squ. Corel Coeff. $R^2$ = 0.96897

Tb in Crude Oil
Std. Dev. σ = 6.7 ppm
Squ. Corel Coeff. $R^2$ = 0.96946

QUANTIFYING ZONAL FLOW IN MULTI-LATERAL WELLS VIA TAGGANTS OF FLUIDS

TECHNICAL FIELD

This disclosure relates to reservoir management involving quantifying zonal flow in multi-lateral wells.

BACKGROUND

A wellbore in a subterranean formation in the Earth crust may be treated. The wellbore treatments may be to facilitate production of hydrocarbon, such as crude oil or natural gas, from the subterranean formation. The wellbore treatments may be to collect data and understand the production.

Hydrocarbon reservoir management may be accomplished by increasing or optimizing the recovery of oil and gas while reducing the capital investments and operating expenses. Flow model predictions may be combined with price forecasts to estimate how much revenue will be generated by a proposed reservoir management plan. Revenue stream forecasts may be used to prepare both short and long term budgets. The reservoir management process can be characterized as integrated, dynamic, and ongoing. The process is integrated because various technical, economic, and other factors may play roles in managing a reservoir, which can work in an integrated manner. For instance, the management may decide when to initiate an enhanced oil recovery (EOR) process on basis of market conditions.

Crude oil development and production in oil reservoirs may be separated into at least the three phases of primary, secondary, and tertiary. Primary recovery (for example, via pressure depletion) and secondary oil recovery (for example, via water injection) in combination generally recover about 20% to 50% of original oil in place (OOIP). Therefore, a large amount of oil (for example, at least 50% of the crude oil in the reservoir) typically remains in the reservoir or geological formation after these conventional oil-recovery processes of primary recovery and secondary recovery. Primary and secondary recovery of production can leave up to 75% of the crude oil in the well. Primary oil recovery is generally limited to hydrocarbons that naturally rise to the surface or recovered via artificial lift devices such as pumps. Secondary recovery employs water and gas injection to displace oil to the surface.

A way to further increase oil production is through tertiary recovery also known as EOR. EOR or tertiary oil recovery increases the amount of crude oil or natural gas that can be extracted from a reservoir or geological formation. Although typically more expensive to employ on a field than conventional recovery, EOR can increase production from a well up to 75% recovery or more. EOR or tertiary recovery can extract crude oil from an oil field that cannot be extracted otherwise. There are different EOR or tertiary techniques.

An understanding of the hydrocarbon flow dynamics, flow paths, and produced/available amounts of hydrocarbon in a given reservoir can aid in reservoir management.

SUMMARY

This disclosure describes technologies relating to taggants for quantification of zonal flow in multi-lateral wells. Certain aspects of the subject matter described can be implemented as a method of quantifying zonal flow in a multi-lateral well formed in a subterranean formation. A first produced fluid including hydrocarbon is flowed from the subterranean formation via a first lateral in a wellbore of the multi-lateral well through a first valve into a production tubing in the wellbore. A second produced fluid including hydrocarbon is flowed from the subterranean formation via a second lateral in the wellbore through a second valve into the production tubing. A first taggant is flowed through a first dosing tubing in the wellbore to the first produced fluid in the first lateral to mix with the first produced fluid prior to the first produced fluid flowing through the first valve into the production tubing. A second taggant is flowed through a second dosing tubing in the wellbore to the second produced fluid in the second lateral to mix with the second produced fluid prior to the second produced fluid flowing through the second valve into the production tubing. The first taggant and the second taggant are different from each other. The first taggant and the second taggant are oil-soluble and each includes a metal complexed with an oil-soluble ligand. A produced stream including the first produced fluid and the second produced fluid is flowed uphole through the production tubing and discharging the produced stream from the wellbore. An amount of the first taggant and an amount of the second taggant in the produced stream are measured. Production of fluid from the multi-lateral well proceeds without ceasing throughout the method.

This, and other aspects, can include one or more of the following features. In some implementations, measuring the amount of the first taggant and the amount of the second taggant in the produced stream includes exposing the produced stream to an X-ray, causing the first taggant and the second taggant to fluoresce. In some implementations, measuring the amount of the first taggant and the amount of the second taggant in the produced stream includes measuring a fluorescence of the first taggant and a fluorescence of the second taggant. In some implementations, measuring the amount of the first taggant and the amount of the second taggant in the produced stream includes determining the amount of the first taggant and the amount of the second taggant in the produced stream based on the measured fluorescence of the first taggant and the measured fluorescence of the second taggant, respectively. In some implementations, the method includes determining an amount of the first produced fluid in the produced stream and an amount of second produced fluid in the produced stream based on the determined amount of the first taggant and the determined amount of the second taggant, respectively, in the produced stream. In some implementations, the first taggant is flowed through the first dosing tubing with a first carrier fluid. In some implementations, the first taggant has a concentration in a range of from about 10,000 parts per million (ppm) to 100,000 ppm in the first carrier fluid. In some implementations, the second taggant is flowed through the second dosing tubing with a second carrier fluid. In some implementations, the second taggant has a concentration in a range of from about 10,000 ppm to 100,000 ppm in the second carrier fluid. In some implementations, the first carrier fluid and the second carrier fluid each includes crude oil, mineral oil, ethanol, chloroform, or any combinations of these. In some implementations, the oil-soluble ligand of the first taggant and the second taggant is a salt of oleic acid (oleate) or stearic acid (stearate). In some implementations, the metal of the first taggant and the second taggant is a rare earth metal or a transition metal. The rare earth metal can be selected from the group consisting of lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), or lutetium (Lu).

The transition metal can be selected from the group consisting of cobalt (Co), manganese (Mn), nickel (Ni), or copper (Cu). In some implementations, the first taggant and the second taggant are each selected from the group consisting of terbium (III) stearate, samarium (III) stearate, cobalt (II) stearate, manganese (II) stearate, terbium (III) oleate, samarium (III) oleate, cobalt (II) oleate, or manganese (II) oleate.

Certain aspects of the subject matter described can be implemented as a method of quantifying zonal flow in a multi-lateral well formed in a subterranean formation. A first taggant is flowed through a first dosing tubing to a first region of a wellbore of the multi-lateral well. The first region is associated with a first lateral of the multi-lateral well. A second taggant is flowed through a second dosing tubing to a second region of the wellbore. The second region is associated with a second lateral of the multi-lateral well. The first taggant and the second taggant are different from each other. The first taggant and the second taggant are oil-soluble and each includes a metal complexed with an oil-soluble ligand. A first produced fluid including the first taggant is flowed from the subterranean formation through the first lateral into a production tubing in the wellbore. A second produced fluid including the second taggant is flowed from the subterranean formation through the second lateral into the production tubing. A produced stream including the first produced fluid and the second produced fluid is flowed uphole through the production tubing and out of the wellbore. An amount of the first taggant and an amount of the second taggant in the produced stream are measured. Production of fluid from the multi-lateral well proceeds without ceasing throughout the method.

This, and other aspects, can include one or more of the following features. In some implementations, the first region includes an intersection of the first lateral with a vertical portion of the wellbore. In some implementations, the second region includes an intersection of the second lateral with the vertical portion. The production tubing can be disposed in the vertical portion. In some implementations, measuring the amount of the first taggant and the amount of the second taggant in the produced stream includes exposing the produced stream to an X-ray, causing the first taggant and the second taggant to fluoresce. In some implementations, measuring the amount of the first taggant and the amount of the second taggant in the produced stream includes measuring a fluorescence of the first taggant and a fluorescence of the second taggant. In some implementations, measuring the amount of the first taggant and the amount of the second taggant in the produced stream includes determining the amount of the first taggant and the amount of the second taggant in the produced stream based on the measured fluorescence of the first taggant and the measured fluorescence of the second taggant, respectively. In some implementations, the method includes determining an amount of the first produced fluid in the produced stream and an amount of second produced fluid in the produced stream based on the determined amount of the first taggant and the determined amount of the second taggant, respectively, in the produced stream. In some implementations, the first taggant is flowed through the first dosing tubing with a first carrier fluid. In some implementations, the first taggant has a concentration in a range of from about 10,000 parts per million (ppm) to 100,000 ppm in the first carrier fluid. In some implementations, the second taggant is flowed through the second dosing tubing with a second carrier fluid. In some implementations, the second taggant has a concentration in a range of from about 10,000 ppm to 100,000 ppm in the second carrier fluid. In some implementations, the first carrier fluid and the second carrier fluid each includes crude oil, mineral oil, ethanol, chloroform, or any combinations of these. In some implementations, the oil-soluble ligand of the first taggant and the second taggant is a salt of oleic acid (oleate) or stearic acid (stearate). In some implementations, the metal of the first taggant and the second taggant is a rare earth metal or a transition metal. The rare earth metal can be selected from the group consisting of lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), or lutetium (Lu). The transition metal can be selected from the group consisting of cobalt (Co), manganese (Mn), nickel (Ni), or copper (Cu). In some implementations, the first taggant and the second taggant are each selected from the group consisting of terbium (III) stearate, samarium (III) stearate, cobalt (II) stearate, manganese (II) stearate, terbium (III) oleate, samarium (III) oleate, cobalt (II) oleate, or manganese (II) oleate.

Certain aspects of the subject matter described can be implemented as a method of quantifying zonal flow in a multi-lateral well formed in a subterranean formation. A first taggant is flowed from the surface of the Earth through a first dosing tubing to a first region of a wellbore of the multi-lateral well. The wellbore is formed through the surface into the subterranean formation. The first region is a region of intersection of a first lateral of the multi-lateral well with a vertical portion of the wellbore. A second taggant is flowed from the surface through a second dosing tubing to a second region of the wellbore. The second region is a region of intersection of a second lateral of the multi-lateral well with the vertical portion. The first taggant and the second taggant are different from each other. The first taggant and the second taggant are oil-soluble and each includes a metal complexed with an oil-soluble ligand. A first produced fluid including the first taggant is flowed from the subterranean formation through the first lateral into a production tubing in the wellbore. A second produced fluid including the second taggant is flowed from the subterranean formation through the second lateral into the production tubing. A produced stream including the first produced fluid and the second produced fluid is flowed uphole through the production tubing and out of the wellbore. The produced stream is exposed to an X-ray, causing the first taggant and the second taggant to fluoresce. A fluorescence of the first taggant and a fluorescence of the second taggant are measured. An amount of the first taggant and an amount of the second taggant in the produced stream are determined based on the measured fluorescence of the first taggant and the measured fluorescence of the second taggant, respectively. Production of fluid from the multi-lateral well proceeds without ceasing throughout the method This, and other aspects, can include one or more of the following features. In some implementations, the method includes determining an amount of the first produced fluid in the produced stream and an amount of the second produced fluid in the produced stream based on the determined amount of the first taggant and the determined amount of the second taggant, respectively, in the produced stream. In some implementations, the first taggant is flowed through the first dosing tubing with a first carrier fluid including crude oil, mineral oil, ethanol, chloroform, or any combinations of these. In some implementations, the first taggant has a concentration in a range of from about 10,000 parts per million (ppm) to 100,000 ppm in the first carrier fluid. In some implementations, the second taggant is flowed through the second dosing tubing with a second carrier fluid including crude oil, mineral oil, ethanol, chloroform, or any combinations of these. In some implementations, the second taggant has a concentration in a range of from about 10,000 ppm to 100,000 ppm in the second carrier fluid. In some implementations, the first taggant and the second taggant are each selected from the group consisting of terbium (III) stearate, samarium (III) stearate, cobalt (II) stearate, manganese (II) stearate, terbium (III) oleate, samarium (III) oleate, cobalt (II) oleate, or manganese (II) oleate.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

Figure 1:
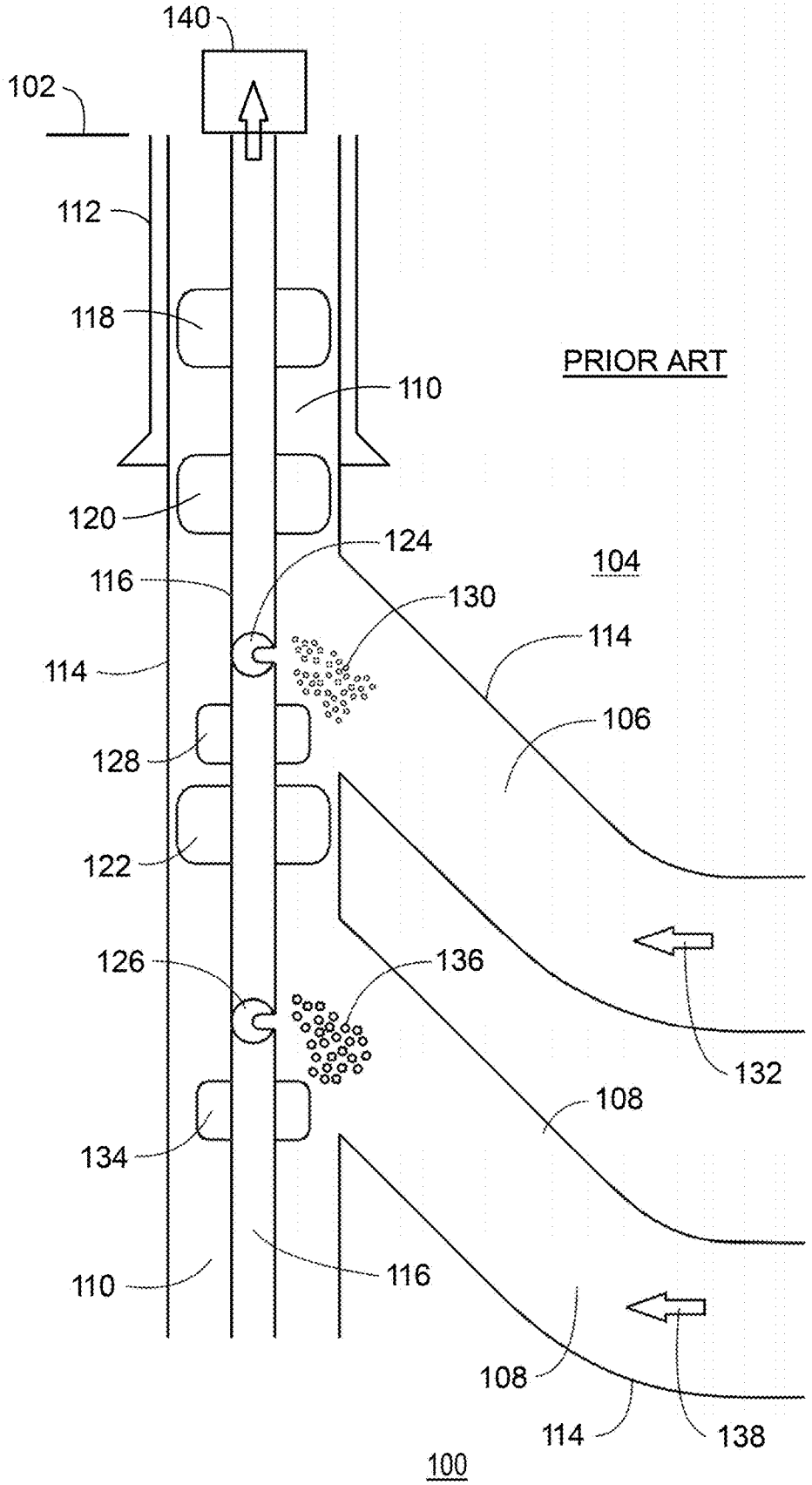
FIG. 1 is a schematic diagram of an example wellbore formed through the Earth surface into a subterranean formation.

This disclosure describes taggants for quantification of zonal flow in multi-lateral wells. The taggants include metal-complexed oil-soluble taggants. The taggants are injected into each lateral of the well by dosing tubing (e.g., capillary dosing lines) that are installed during well completion. The taggants can be injected from the well head into different downhole zones (laterals) during routine well performance diagnostics without requiring a disruption in production of fluids from the well. An abrupt tracer dosing shut off generates a transient in tracer concentrations as the production flows carrying the tracers to the surface, obviating the need to shut in the well. The taggants are dissolved and/or suspended in carrier fluids that are miscible with the target fluid phase downhole. The taggants dosed into the laterals and collected with the production fluid can be analyzed to determine taggant concentration and quantify the contributions of various phases (e.g., water and oil) from each lateral to assess production efficiency. Data from the calculated zonal flow contribution can inform and aid subsequent adjustments of production parameters to improve hydrocarbon recovery from the multi-lateral well.

The subject matter described in this disclosure can be implemented in particular implementations, so as to realize one or more of the following advantages. The described taggants and methods allows for the ability to infer zonal oil and water contributions from various laterals in a multi-lateral well with simple surface measurements, without having to perform downhole metering, which can involve attendant cabling, downhole electronic devices, and their associated costs. The described taggants and methods employ dosing tubings which can be used to infer zonal oil and water contributions from various laterals in a multi-lateral well without ceasing production from the multi-lateral well, such that losses associated with production downtime are avoided. The dosing tubings can be installed permanently during well completion. Abrupt tracer (taggant) dosing shut-off of the taggants described can generate the transient in tracer concentrations as the production fluids carry the tracers to the surface, which precludes the need to shut in the well to make such measurements and calculations. The taggants described can be identified in samples having concentrations of the respective taggants, in some cases, as low as about 5 parts per million (ppm) for accurately determining oil and/or water contributions from the various laterals in a multi-lateral well. The taggants described can be implemented in fluid tracing applications without requiring pre-sample purification procedures before implementation, which is typically required for conventional taggants.

The carrier fluid of the tracers (taggants) as injected may be crude oil, mineral oil, ethanol, chloroform, or any combinations of these. For example, the carrier fluid can be a mixture of ethanol and chloroform, having an ethanol-to-chloroform ratio of about 1:1. At surface, analytical techniques may be employed to measure or detect tracers in produced fluid.

The tracer (taggant) concentrations dosed into the laterals and collected with the produced fluids at the surface over a prescribed time duration are utilized to quantitate (quantify) the contributions of fluids (produced fluids) from each lateral. The tracers may be selectively soluble taggants of fluids for quantification of zonal flow in multi-lateral wells (multi-lateral wellbores). The tracers may be selectively soluble, for example, for hydrocarbon phases or crude oil (oil-soluble).

Selectively soluble taggants are injected from the surface via dosing lines (tubing, conduits) into different sections or zones of a multilateral well. These taggants are designed to mark different fluid phases produced from each zone and be carried by the produced oil and water to the surface. Their concentrations measured at the surface—specifically, how their concentrations decrease over time after dosing is shut off—may allow for the computation of the oil producing rates from each zone.

Compositions of the oil-soluble taggants include a metal that is complexed with an oil-soluble ligand. The oil-soluble ligand can include a salt of oleic acid (oleate) or stearic acid (stearate). The metal that is complexed with the oil-soluble ligand can be a rare earth metal or a transition metal. Some non-limiting examples of rare earth metals that can be complexed with the oil-soluble ligand include lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), and lutetium (Lu). Some non-limiting examples of transition metals that can be complexed with the oil-soluble ligand include cobalt (Co), manganese (Mn), nickel (Ni), and copper (Cu). Some non-limiting examples of the oil-soluble taggants include terbium (III) stearate, samarium (III) stearate, cobalt (II) stearate, manganese (II) stearate, terbium (III) oleate, samarium (III) oleate, cobalt (II) oleate, and manganese (II) oleate.

Different classes of oil-soluble taggants are described, such as lanthanide ions complexed by hydrophobic ligands, e.g., beta-diketonate complexes, dodecane tetraacetic acid-based macrocyclic complexes, etc., for detection by X-ray fluorescence (XRF), inductively coupled plasma (ICP) spectroscopy, and/or ICP spectroscopy-mass spectroscopy (MS).

Disclosed are the characteristics and the formulation of a carrier fluid in which the taggants would be dissolved or suspended in, so that they can be injected and transported into the interval (lateral, zone) from the surface. The carrier fluid is miscible with the target-fluid phase downhole. The taggants can be dissolved or suspended in the carrier fluid at concentrations above 10,000 parts per million (ppm), such as in the range of from about 10,000 ppm to about 100,000 ppm or from about 10,000 ppm to about 30,000 ppm. For oil-soluble taggants, the boiling point of the carrier fluid is preferably greater than 100° C. with low volatility/flash point, e.g., dodecanol. The taggants could also be dissolved or suspended in crude oil or crude oil diluted with solvents.

The complexities of well completions have increased steadily over the years with the rapid advancement in extended reach drilling technology. Wells are routinely completed in multilayered reservoirs, with multilaterals that have compartments with varying pressure. Intelligent completions that include valves and sensors can contribute to efficient reservoir management practice to monitor production and execute appropriate and beneficial well intervention. The valves may include, for example, flow control valves (FCVs). The sensors may include sensors or gauges [e.g., permanent downhole gauges (PDGs)] and may measure, for example, that measure water cut (e.g., volume percent water) and fluid flow rate (e.g., mass per time or volume per time) including in real time. In such intelligent completions, electrically controllable FCVs can be remotely adjusted in real-time to increase, balance, or optimize production after oil and water rate feedbacks from downhole PDGs in the field for relatively large areas of a reservoir, increasing or maximizing hydrocarbon recovery with shorter optimization cycle due to more informed reservoir management decisions.

In one example, the Manara production and reservoir management system, which was launched as a collaboration between Saudi Arabian Oil Company (having headquarters in Dhahran, Saudi Arabia) and Schlumberger Limited (SLB) (having headquarters in Houston, Texas, USA), provides for simultaneous, real-time monitoring and control utilizing a single electric control line of up to 60 compartments in multilateral wells, with extended-reach sections longer than 12 kilometers (km). Nonetheless, even with the commercialization of the Manara platform in September 2015, pervasive adoption of the technologies that enable or facilitate compartment-level control have been stymied by costs and long-term device reliability in high salinity and pressure downhole conditions.

For multilateral wells, the installation of interval control valves (ICVs) that can have adequate controls (e.g., simplified controls), run history (e.g., long-term run history), and reliability may be a beneficial intermediate step toward the vision of full-field deployment of entirely automatable intelligent completions with real-time optimization controls. The employment of production logging tools and data from production history, flow tests, downhole gauge readings, zonal production allocation, and well performance analysis may be inferred and the increasing or optimization of hydrocarbon production can be achieved with adjustments of the ICVs. However, the ability to infer zonal oil and water contribution from different laterals with simple surface measurements, without having to perform downhole metering (involving attendant cabling, downhole electronic devices, and associated costs) may still be highly desirable.

Resman AS is a Norwegian service company offering a tracer technology that embeds unique chemical tracers into a porous polymer resin, such as indicated in FIG. 1. These resin monoliths are installed during well completions and can be placed at different production intervals as a semi-permanent (e.g., approximate 10-year lifetime) downhole monitoring system. When the resins containing the tracers are exposed to the target well fluids (hydrocarbon and/or water), the unique tracers are released at a rate that can be interrogated at relatively high sensitivity at the surface. Because the detection of constantly released tracers from different intervals at the surface does not offer quantifiable information other than which zone is producing, the creation of a transient is therefore implemented for quantitation of fluid production rates from each interval. This necessitates a temporary shut-in of production at the surface, which may introduce artifacts in the fluid flow that do not accurately characterize zonal contribution when production is resumed. In addition, the release of chemical tracers from a polymer matrix is mechanistically complex and dependent on chemical diffusion, interfacial phenomena, and various chemical interactions between the sequestered tracer and the polymer matrix. To engineer a similar degradable material system suitable for the expected operational environment would require substantial expertise and time investment.

Figure 2:
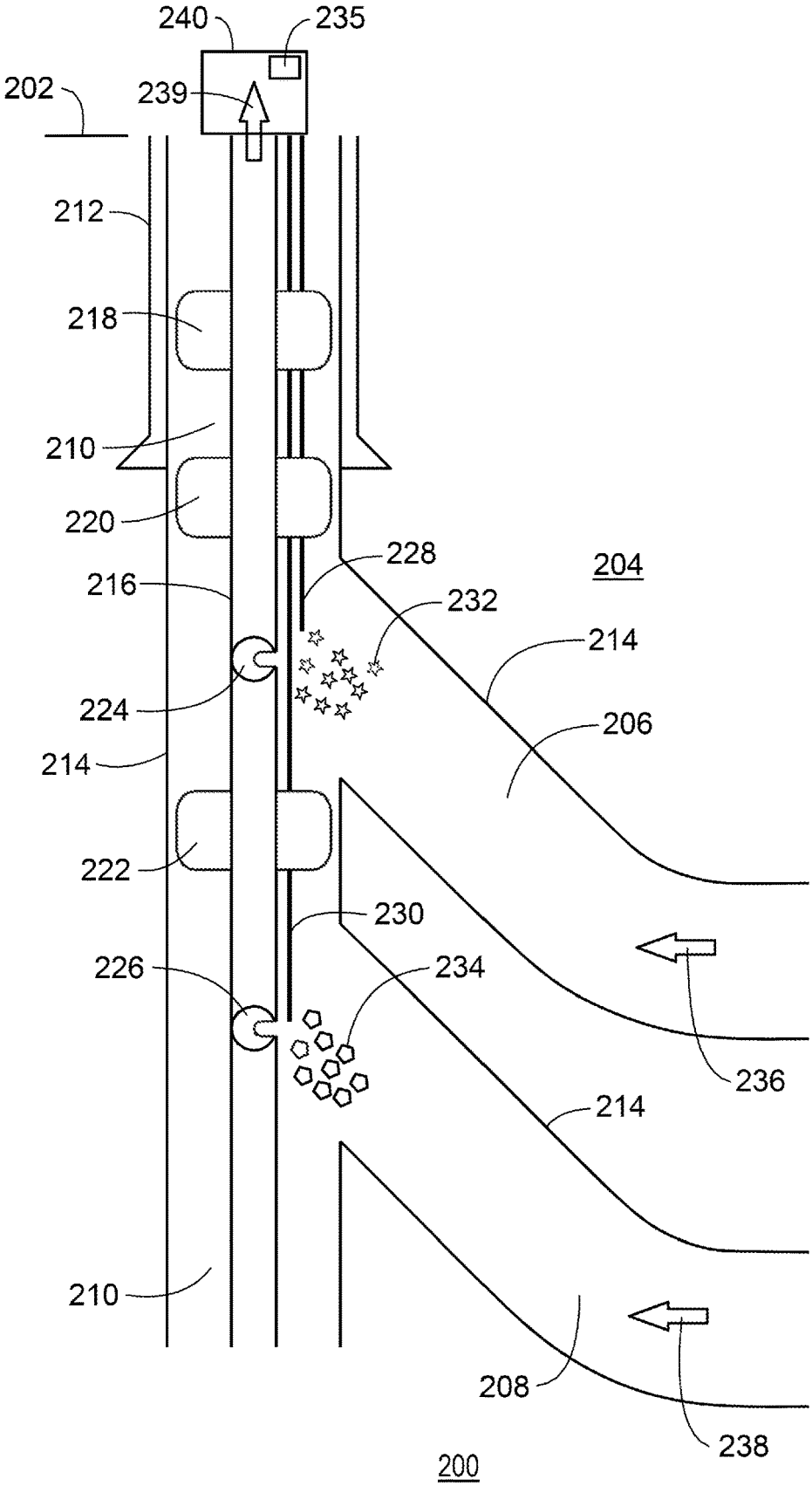
FIG. 2 is a schematic diagram of an example wellbore formed through the Earth surface into a subterranean formation.

As indicated in FIG. 2, a different technique may measure at surface the zonal oil and water contribution to fluid flow without disruption to production. By installing a dosing line (tubing) (e.g., passive, capillary, permanent or substantially permanent) from the surface during well completion, selectively soluble tracers can be injected from the wellhead into the different zones during routine well performance diagnostics. An abrupt tracer dosing shut-off would generate the transient in tracer concentrations as the production flows carry the tracers to the surface, obviating the need to shut in the well.

FIG. 1 and FIG. 2 provide for a comparison of features between selective soluble tracers dosed via dosing tubing from the surface (FIG. 2) and a controlled-release resin installed as part of the completion (FIG. 1). The technique indicated by FIG. 1 generally needs a well shut-in for measurement and analysis. The technique indicated by FIG. 2 generally can avoid a well shut-in for measurement and analysis. Thus, the technique indicated by FIG. 2 can be implemented to quantify zonal flow in multi-lateral wells without ceasing production of fluid from such wells, which can improve production efficiency.

FIG. 1 is a wellbore 100 formed through the Earth surface 102 into a subterranean formation 104 of the Earth crust. The wellbore 100 has a vertical portion and two laterals including a first lateral 106 and a second lateral 108. The wellbore 100 includes a borehole 110 and a borehole wall 114 (wellbore wall) at the interface with subterranean formation 104. The wellbore 100 may include casing 112 (reservoir casing) disposed along the borehole wall 114. The borehole wall 114 may be reservoir rock in the openhole case, or casing or metal liner in the reservoir rock in cased portions of the wellbore. The wellbore 100 may include production tubing 116 disposed in the borehole 110.

Portions of the wellbore 100 can be an open completion. For example, vertical portions can be openhole and/or the laterals can be openhole. The wellbore 100 can be generally a cased completion. This top casing is depicted, but the casing can go further down along the vertical portion to at least the laterals. While not fully shown for clarity, the casing 112 may generally run the length of the vertical portion of the wellbore 100, and in some cases, along the two laterals 106 and 108. Moreover, it should be noted that while only two laterals are depicted, the wellbore 100 may have more than two laterals.

During production, produced fluid may flow from the subterranean formation 104 into the laterals 106, 108. The produced fluid (e.g., hydrocarbon) may flow, for example, through the openhole borehole wall 114 into the lateral, or for a cased completion of the laterals, through perforations (not shown) in the casing 112 into the lateral. The hydrocarbon produced via the first lateral may include crude oil or natural gas, or both. The hydrocarbon produced via the second lateral may include crude oil or natural gas, or both. The produced fluid can include water in implementations. Thus, the produced fluid via one or both of the laterals 106, 108 can include hydrocarbon and water.

Production tubing 116 may be situated in the borehole 110 in the vertical portion of the wellbore 100. The wellbore 100 may have packers, such as the depicted isolation packers including a first packer 118, a second packer 120, and a third packer 122. A purpose of the first packer 118 may be a redundancy of additional sealing in case leakage across the second packer 120.

The illustrated implementation includes two valves (first valve 124 and second valve 126) disposed along the production tubing 116 to receive produced fluid from the two laterals, respectively, into the production tubing. The first valve 124 and the second valve 126 may each be, for example, an interval control valve (ICV). In implementations, interval or flow control valves can be operated automatically, manually, or remotely as part of an intelligent completion. Utilized to control multiple zones (laterals) selectively, the ICVs may reduce water cut and gas cut, reduce well interventions, and increase well productivity. Intelligent completions may address completion challenges (and reservoir management tasks) arising from deviated, extended-reach, multi-targeted, or multilateral wells.

A first resin 128 (e.g., a resin pack) is disposed in the borehole 116 to release a first taggant 130 (first tracer) into the first produced fluid 132 flowing from the first lateral 106. The first taggant 130 may be gradually release from the resin pack as the resin pack is exposed to target wellbore fluids, such as hydrocarbon. A second resin 134 (e.g., a resin pack) is disposed in the borehole 116 to release a second taggant 136 (second tracer) into the produced fluid 138 flowing from the second lateral 108. The second taggant 136 may be gradually released from that resin pack as the resin pack is exposed to target wellbore fluids, such as hydrocarbon. The second taggant 136 may be different from the first taggant 130. A temporary well shut-in may be required, for example, at about 8 hours to 72 hours to accumulate the taggants 130, 136 to build up the concentration of the respective taggant in each zone. Then, as the well is reopened, pulses of the taggants 130, 136 (e.g., dyes) indicating respective production of the two zones will be produced in proportion to the respective lateral influx rate.

The first produced fluid 132 and the second produced fluid 138 are produced from (flow from) the subterranean formation 104 into first lateral 106 and the second lateral 108, respectively. The first produced fluid 132 and the second produced fluid 138 each generally include hydrocarbon, such as crude oil and/or natural gas. The first produced fluid 132 and the second produced fluid 138 may each include water.

In operation, the first valve 124 receives the first produced fluid 132 at a flow rate Q1 from the first lateral 106 into the production tubing 116. The second valve 126 receives the second produced fluid 138 at a flow rate Q2 from the second lateral 108 into the production tubing 116. The flow rates Q1 and Q2 may each be, for example, volume per time. The combined flow (Q1 and Q2) of the produced fluid 132, 138 is upward through the production tubing 116 toward uphole and exits the wellbore 100 by discharging from the borehole 110 through a wellhead 140 at the surface 102. The combined stream of the produced fluid 132, 138 may be analyzed to detect the taggants 132, 138 to determine the relative contribution of the first produced fluid 136 and the second produced fluid 138 to the combined stream. A well shut-in is generally required for analysis/calculation. Without a shut-in of the well, there would be no transient in tracer concentrations from, for example, two different zones. The tracers injected into the different zones will be constantly released out in steady state to the surface and you don't get any meaningful information for each zone from the tracer dye signal on the surface because the flows are comingled from all the laterals.

FIG. 2 is a wellbore 200 formed through the Earth surface 202 into a subterranean formation 204 of the Earth crust. The wellbore 200 has a vertical portion and two laterals including a first lateral 206 and a second lateral 208. The wellbore 200 includes a borehole 210 in the vertical portion and in the laterals. The wellbore 200 has casing 212 and borehole wall 214 along the borehole 210. For openhole, the borehole wall 214 is the subterranean formation 204 (e.g., reservoir rock). For presence of casing, the borehole wall 214 (or wellbore wall) can be the casing or metal liner embedded in the subterranean formation 204 along the perimeter of the borehole 210.

While not fully shown for clarity, the casing 212 may generally run the length of the vertical portion of the wellbore 200 (vertical portion of the borehole 210), and in some implementations, along the two laterals 206 and 208. During production, produced fluid may flow from the subterranean formation 204 into the laterals 206, 208.

Production tubing 216 may be situated in the borehole 210 in the vertical portion of the wellbore 200. The wellbore 200 may have packers, such as the depicted isolation packers including a first packer 218, a second packer 220, and a third packer 222. Further, the illustrated implementation includes two valves (first valve 224 and second valve 226) disposed along the production tubing 216 to receive produced fluid from the two laterals, respectively, into the production tubing 216. The first valve 224 and the second valve 226 may each be, for example, an ICV, as discussed with respect to FIG. 1.

A first dosing tubing 228 (e.g., capillary dosing line) runs from the surface 202 into the wellbore 200 (into the borehole 210) to the intersection of the first lateral 206 with the vertical portion of the wellbore 200. The term "capillary" here may simply mean the tubing as having a relatively narrow or small diameter.

A second dosing tubing 230 (e.g., capillary dosing line) runs from the surface 202 into the wellbore 200 (into the borehole 210) to the intersection of the second lateral 208 with the vertical portion. The dosing tubing 228, 230 may be small in diameter, such as having a nominal diameter of less than 1 inch or less than 0.5 inch, such is the ranges of 0.1 inch to 0.5 inch, or 0.1 inch to 0.3 inch.

Taggants (tracers) 232, 234 may be applied from surface 202 through the dosing tubing 228, 230 into the borehole 210. In implementations, a surface pump(s) 235 at the surface 202 may provide motive force for flow of the taggants 232, 234 through the dosing tubing 228, 230 into the borehole 210. The first taggant 232 is different from the second taggant 234.

A carrier fluid may be utilized in the application (injection) of the first taggant 232 through the first dosing tubing 228 and the second taggant 234 through the second dosing tubbing 230. The carrier fluid may be, for example, crude oil, mineral oil, certain solvents, or any combinations of these. The taggants 232, 234 may be liquid and dissolve (in solution) in the carrier fluid and in the wellbore fluid (produced fluid).

The first taggant 232 (first tracer) may be provided via the first dosing tubing 228 to an intersection region of the wellbore vertical portion and the first lateral 206. Thus, the first taggant 232 discharges from the first dosing tubing 228 into the first produced fluid 236 flowing from the first lateral 206 toward the production tubing 216. The first taggant 232 may be provided via the first dosing tubing 228 to adjacent to the first valve 224. The amount (e.g., volume or mass) and flow rate (e.g., volume per time or mass per time) of the first taggant 232 through the dosing tubing (tube) 228 into the wellbore 200 may be specified (as implemented) and known.

The second taggant 234 (second tracer) may be provided via the second dosing tubing 230 to an intersection region of the wellbore vertical portion and the second lateral 208. Thus, the second taggant 234 discharges from the second dosing tubing 230 into the second produced fluid 238 flowing from the second lateral 208 toward the production tubing 216. The second taggant 234 may be provided to adjacent to the second valve 226 in the region of the intersection of the vertical portion and the second lateral 208. The amount (e.g., volume or mass) and flow rate (e.g., volume per time or mass per time) of the second taggant 234 through the dosing tubing (tube) 230 into the wellbore 200 may be specified and known. Again, the taggants 232, 234 may be applied (injected) in the aforementioned carrier fluid through the dosing tubes 228, 230 into the wellbore 200.

The concentration of the taggants 232, 234 in the produced fluid at surface 202 may generally depend on the amount of the taggant injected. Knowing or specifying the flow rates (mass or volume) of the dosed taggants 232, 234 as applied may facilitate evaluating the taggant concentration (maximum taggant concentration) in the produced at surface. It may be beneficial to measure down to a few percent (e.g., less than 3% by weight) in the produced fluid to map out the decay rates of the taggant concentration once the taggant dosing is shut off. The amount of taggant dosed may be related to detection of the taggant. Moreover, the rate of dosed taggant may be specified to facilitate a saturated concentration of the taggant to generate pulses of dyes indicating the two zones.

The taggants 232, 234 (tracers) may be soluble in oil including crude oil, and characterized as oil-soluble. The taggants 232, 234 are be oil-soluble taggants (tracers) including a rare earth metal or a transition metal complexed to an oil-soluble ligand. The taggants 232, 234 can be, for example, selected from the group consisting of terbium (III) stearate, samarium (III) stearate, cobalt (II) stearate, manganese (II) stearate, terbium (III) oleate, samarium (III) oleate, cobalt (II) oleate, or manganese (II) oleate. The taggants 232, 234 are different from each other, such that the taggants 232, 234 can be associated with the different laterals 206, 208, respectively. For example, the taggant 232 is associated with the lateral 206, and the taggant 234 is associated with the lateral 208. In some cases, at least one of the taggants 232 or 234 can include a mixture of oil-soluble taggants.

As indicated with respect to FIG. 1, in operation for FIG. 2, the first produced fluid 236 and the second produced fluid 238 are produced from (flow from) the subterranean formation 204 into the first lateral 206 and the second lateral 208, respectively. As mentioned, the first produced fluid 236 and the second produced fluid 238 may each flow through perforations in the casing 212 and the cement 214 into the borehole of the first lateral 206 and the second lateral 208, respectively. The first produced fluid 236 and the second produced fluid 238 may each include hydrocarbon, such as crude oil and/or natural gas.

In operation, the first valve 224 receives the first produced fluid 236 at a flow rate Q1 from the first lateral 206 into the production tubing 216. The second valve 226 receives the second produced fluid 238 at a flow rate Q2 from the second lateral 208 into the production tubing 216. The flow rates Q1 and Q2 may each be, for example, volume per time, and may be analogous to Q1 and Q2 discussed with respect to FIG. 1. The combined flow (flow rates Q1 and Q2) of the produced fluid 236, 238 of the discharge stream 239 is upward through the production tubing 216 toward uphole and exits the wellbore 200 by discharging from the borehole 210 through a wellhead 240 at the surface 202.

This discharged produced stream 239 of the combined produced fluid 236, 238 (total flow rate=Q1+Q2) may be analyzed to detect or measure the taggants 232, 234 (tracers) in the produced stream 239 to determine the relative contribution of the first produced fluid 236 (and/or hydrocarbon [e.g., crude oil] in the first produce fluid 236) and the second produced fluid 238 (and/or hydrocarbon [e.g., crude oil] in the second produced fluid 238) to the produced stream 239 (combined produced fluid 236 and 238) that discharges at the surface 202. Again, the tracers 232, 234 are oil-soluble and thus in the crude oil of (or the crude oil phase in) the first produced fluid 236 and in the second produced fluid 238.

The taggants 232, 234 in the produced stream 239 may be measured or detected, for example, via X-ray fluorescence (XRF) analysis or other measurement techniques. XRF measurement may refer to noncontact t measurement utilizing X-ray sources. XRF detection/measurement can employ at least one X-ray source and a detector. XRF measurement may be a measurement technique that relies on the use of solid-state sensors to collect measurements. Several different types of systems (analytical instruments) are available for XRF detection, including fully automated ones, as well as systems that allow for more manual control. XRF measurement can be noninvasive. The features of excitation and emission can be involved. Further, the presence and/or concentrations of different metal ions can be distinguished from one another by an energy dispersive detector. Multiple oil-soluble taggants can be mixed in a particular lateral. For example, taggant 232 for lateral 206 or taggant 234 for lateral 208 can include a mixture of oil-soluble taggants if the X-ray peaks for the individual taggants in the mixture do not overlap in XRF analysis.

An online analytical instrument (e.g., for performing optical detection or other types of measurements) may be employed to automatically sample the produced stream 239 at surface 202 for measurement in the field of the taggants 232, 234 (e.g., in near real time). On the other hand, a sample of the produced stream 239 may be manually collected by a human operator or technician at surface 202 and subjected to analysis (e.g., optical detection or other measurement technique) for the taggants 232, 234 via a laboratory analytical instrument in a laboratory (e.g., in a mobile laboratory at the well site having the wellbore 200).

The analytical instruments and techniques for detection or measurement (e.g. optical) of the oil-soluble taggants (tracers) may include spectrometric techniques. In implementations, the detection of the taggants 232, 234 in the produced stream 234 may be at trace concentrations (e.g., less than 5 part per million (ppm) by weight).

In implementations, a well shut-in (shut-in of the wellbore 200) is generally not implemented for the measurements of the discharged produced stream 239 at surface 202 for the taggants 232, 234. In other words, transients may be generated with the dosing procedure of the taggants. For example, the actions of the dosing procedure that generate a transient include an abrupt discontinuing of the dosing.

The techniques include measuring zonal oil and water contribution to fluid flow by detecting oil-dissolved tracers at the surface without disruption to production (without shut-in the well). For this, by installing dosing tubing from the surface during well completion, oil soluble tracers can be injected from the wellhead into the different zones. Once injected, first, steady-state tracer dosing can be measured at the surface because there is a constant flow coming out from the production well. Then, to introduce a transient in tracer concentrations, only the tracer dosing can be abruptly shut off (not the whole production). Then the production flows from each zone will carry the tracers to the surface, which will decay at a different rate. These decay rates are proportional to the influx rate of each zone. So, in this case, shut-in the well is not required, instead the transient is generated by tracer dosing procedure.

The dosing procedure may include: [1] injecting the first taggant 232 (e.g., in a carrier fluid) through the first dosing tubing 228 (conduit) to the first lateral 206 and adjacent the valve 224; [2] injecting the second taggant 234 (e.g., in a carrier fluid) through the second dosing tubing 230 (conduit) to the second lateral 208 and adjacent the valve 226; [3] abruptly shutting off the taggants 232, 234 to generate a transient; and [4] measuring the amount and flow rate of the taggants 232, 234 (tracers) at surface in produced stream 239. The measurement and calculation procedure may include: [A] measuring concentrations of the taggants 232, 234 (tracers) in the produced stream 239; and [B] calculating the amount of the first produced fluid 236 and the amount of the second produced fluid 238 based on the amount and rate of taggants 232, 234 injected and based on the concentrations of the taggants 232, 234 in the produced stream 239.

In implementations, the amount of oil (e.g., crude oil) in the produced fluid can be determined, and the amount of water in the produced fluid can be determined. The production (produced fluid) flows from each zone (laterals 206, 208) carrying the respective taggants 232, 234 to the surface, and in which respective concentrations of the taggants 232, 234 in the produced fluid may generally decay at a different rates after shutting off the taggant dosing. The amount of oil and water can be determined because the decay rates may be proportional to the influx rate (production rate of produced fluid) of each zone, and with the taggants being selectively soluble in oil. For a discussion of tracer decay rates, see U.S. patent application Ser. No. 17/644,641, which issued as U.S. Pat. No. 12,000,278, which is incorporated by reference herein in its entirety.

Embodiments further detail different classes of oil-soluble tracer/taggant materials that can be injected each lateral of the well to tag the hydrocarbon phase of the reservoir fluid. Each class of materials is described for its suitability as an oleophilic taggant in terms of: (i) simplicity of detection modality, which has implications on the development of a fieldable analysis instrument, (ii) detection sensitivity in crude oil matrix, (iii) short-term stability under downhole condition and long-term stability in crude oil, and (iv) ease of commercialization or availability of commercial sources for the materials. The taggant will be dissolved in a carrier fluid, e.g., crude oil, mineral oil, solvent mixtures, etc., that facilitates the taggant to be delivered to the laterals via the dosing lines.

The taggants disclosed herein as applicable may include known compounds that are commercially available (as well as novel compositions) that have not been applied to this purpose of tagging different phases of reservoir fluids for quantification of zonal flow contributions in multilateral wells.

The characteristics and the formulation of a carrier fluid in which the taggants would be dissolved or suspended, so that the taggants can be effectively injected and transported into the interval from the surface are discussed. The carrier fluid is miscible with the target-fluid phase (e.g., crude oil) downhole. The taggants can be dissolved or suspended in the carrier fluid at concentrations above 10,000 parts per million (ppm), e.g., in the range of from about 10,000 ppm to about 100,000 ppm or in a range of from about 10,000 ppm to about 30,000 ppm. The boiling point of the carrier fluid may be greater than 100° C. (e.g., in a range of 100° C. to 225° C.) with relatively low volatility/flash point, e.g., dodecanol. The taggants could also be dissolved or suspended in crude oil or crude oil diluted with a solvent.

Discussed below are the chromatographic and spectrometric techniques for the separation of the taggant materials from dissolved organic matter interferents in the aqueous and oil phases of the produced fluids and their detection at trace (e.g., less than 5 ppm).

The concentrations of the taggants dosed into the laterals and collected with the produced fluids at the surface over a prescribed time duration may be utilized to quantitate (quantify) the contributions of fluids (oil and water) from each lateral in the assessment of production efficiency. Data from the calculated zonal flow contribution may inform and aid the subsequent adjustments of production parameters to improve reservoir management and increase hydrocarbon recovery.

Figure 3:
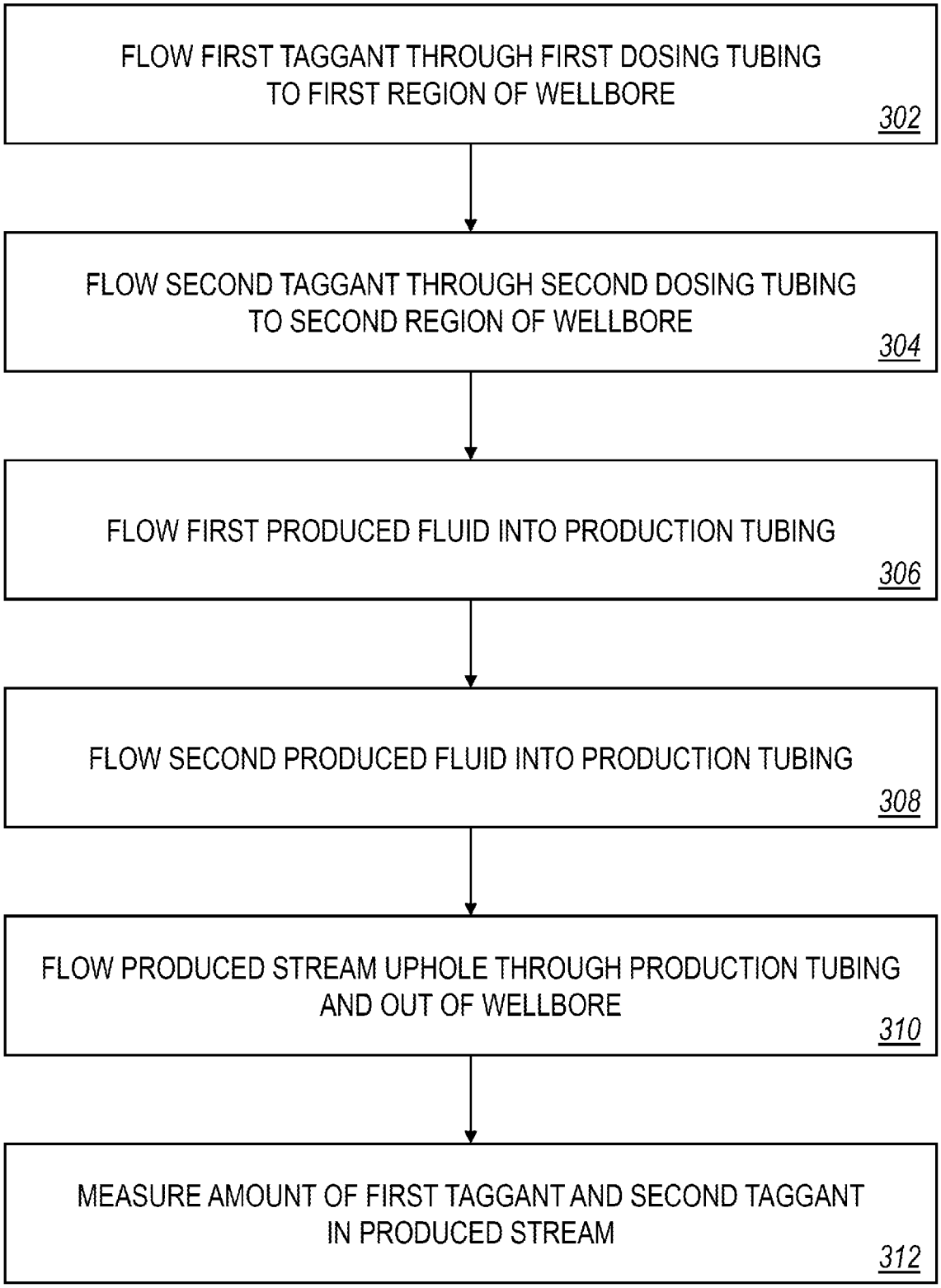
FIG. 3 is a flow chart of an example method of quantifying zonal flow in a multi-lateral well.

FIG. 3 is a flow chart of a method 300 of quantifying zonal flow in a multi-lateral well. The multi-lateral well includes a wellbore (such as the wellbore 200) formed through the Earth surface (such as the surface 202) into a subterranean formation (such as the formation 204) in the Earth crust. The wellbore includes a vertical portion and at least two laterals (such as the first lateral 206 and second lateral 208). The laterals can be known as zones. The produced fluid (such as the first produced fluid 236) from the first lateral 206 (first zone) may include hydrocarbon (e.g., crude oil and/or natural gas) and/or water. The produced fluid (such as the second produced fluid 238) from the second lateral 208 (second zone) may include hydrocarbon (e.g., crude oil and/or natural gas) and/or water.

At block 302, a first taggant (tracer, such as the taggant 232) is flowed from the Earth surface 202 through a first dosing tubing (e.g., a first capillary dosing line, such as the tubing 228) to the first lateral 206 in the wellbore 200. A purpose of flowing (for example, injecting) the first taggant 232 may be to tag fluid that is produced (236) via the first lateral 206. The first taggant 232 may be intended to tag produced fluid 236 from the first lateral 206 so that this produced fluid 236 can be identified. This produced fluid 236 flows through the first lateral 206 from the subterranean formation 204 to a production tubing (such as the production tubing 216).

The first taggant 232 may be provided from the Earth surface 202 through the first dosing tubing 228 to a first region associated with the first lateral 206. The first region may be a region of intersection of the first lateral 206 with the vertical portion. The first taggant 232 may discharge from the first dosing tubing 228 into the wellbore 200 (e.g., into the first region), such as near or adjacent to a first valve (e.g., first ICV) disposed along production tubing 216 in the vertical portion of the wellbore 200. A pump at the surface 202 may be utilized to provide motive force for flow of the first taggant 232 through the first dosing tubing 228.

At block 304, a second taggant (tracer, such as the taggant 234) is flowed from the Earth surface 202 through a second dosing tubing (e.g., a second capillary dosing line, such as the tubing 230) to the second lateral 208 in the wellbore. The second taggant 234 may be intended to tag produced fluid 238 from the second lateral 208 so that this produced fluid 238 can be identified. A purpose of flowing (for example, injecting) the second taggant 234 may be to tag fluid 238 that is produced via the second lateral 208 (and flows through the second lateral 208 from the subterranean formation 204 to the production tubing 216).

The second taggant 234 may be provided from the Earth surface 202 through the second dosing tubing 230 to a second region associated with the second lateral 208. The second region may be a region of intersection of the second lateral 208 with the vertical portion of the wellbore 200. The second taggant 234 may discharge from the second dosing tubing 230 into the wellbore 200 (e.g., into the second region), such as near or adjacent to the second valve (e.g., second ICV) disposed along the production tubing 216. A pump at the surface 202 may be utilized to provide motive force for flow of the second taggant 234 through the second dosing tubing 230.

The first taggant 232 and the second taggant 234 are oil-soluble. The first taggant 232 may be different from the second taggant 234. The first taggant 232 and the second taggant 234 may each be at least one of terbium (III) stearate, samarium (III) stearate, cobalt (II) stearate, manganese (II) stearate, terbium (III) oleate, samarium (III) oleate, cobalt (II) oleate, or manganese (II) oleate, or other oil-soluble taggants discussed herein.

At block 306, the first produced fluid 236 (having hydrocarbon and possible water) is flowed (produced) from the subterranean formation 204 via (through) the first lateral 206 through the first valve (e.g., ICV) into the production tubing 216 in the wellbore. Again, the production tubing 216 may be in a vertical portion of the wellbore.

At block 308, the second produced fluid 238 (having hydrocarbon and possible water) is flowed (produced) from the subterranean formation 204 via the second lateral 208 through the second valve (e.g., ICV) into the production tubing 216. As mentioned, the first valve and the second valve may be disposed along production tubing 216 to receive fluid into the production tubing 216.

At block 310, a produced stream (such as the stream 239) including the first produced fluid 236 and the second produced fluid 238 is flowed (produced) uphole through the production tubing 216 and discharged from the wellbore 200. Producing the first produced fluid 236 may involve flowing the first produced fluid 236 from the first lateral 206 through the first valve into the production tubing 216, and producing the second produced fluid 238 may involve flowing the second produced fluid 238 from the second lateral 208 through the second valve into the production tubing 216, wherein the first valve and second valve are disposed along the production tubing 216. The first produced fluid 236 and the second produced fluid 238 combine in the production tubing 216, and the combination discharges at surface 202 as the produced stream 239 from the production tubing 216 and the wellbore 200.

At block 312, the produced stream 239 (e.g., at Earth surface) is analyzed to determine (measure) an amount (first-taggant amount) of the first taggant 232 in the produced stream 239 and an amount (second-taggant amount) of the second taggant 234 in the produced stream 239. The analytical techniques (instruments) may include, for example, ultraviolet (UV)-vis spectroscopy, fluorescence spectroscopy, X-ray fluorescence (XRF), inductively coupled plasma (ICP) spectroscopy, and/or ICP spectroscopy-mass spectroscopy (MS), and the like. The XRF analysis at block 312 can include exposing the produced stream 239 to an X-ray, which causes the first taggant 232 and the second taggant 234 to fluoresce. The XRF analysis at block 312 can include measuring a fluorescence of the first taggant 232 and a fluorescence of the second taggant 234. The XRF analysis at block 312 can include determining the amount (first-taggant amount) of the first taggant 232 in the produced stream 239 and the amount (second-taggant amount) of the second taggant 234 in the produced stream 239 based on the measured fluorescence of the first taggant 232 and the measured fluorescence of the second taggant 234, respectively.

An amount of the first produced fluid 236 (the first produced-fluid amount) in the produced stream 239 and an amount of second produced fluid 238 (the second produced-fluid amount) in the produced stream 239 can be determined (e.g., calculated) based on the amount of the first taggant 232 in the produced stream 239 as measured at block 312 and the amount of the second taggant 234 in the produced stream 239 as measured at block 312.

Embodiments measure zonal produced fluid contribution to the total produced fluid by detecting oil-dissolved tracers at the surface without disruption to production (without shut-in of the well). For this, with aid of doing tubing from the surface, oil-soluble tracers can be injected from the wellhead into the different zones. Once injected, steady-state tracer dosing can be measured at the surface because there is a constant flow coming out from the production well. Then, to introduce a transient in tracer concentrations, the tracer dosing can be abruptly shut off (not the whole production). Then the production flows from each zone will carry the tracers to the surface, which will decay at a different rate. These decay rates are proportional to the influx rate of each zone. So, in this case, shut-in the well is not required, instead the transient is generated by tracer dosing implementation.

Again, the method 300 may include determining an amount of the first produced fluid 236 in the produced stream 239 and an amount of second produced fluid 238 in the produced stream 239 based on the amount of the first taggant 232 in the produced stream 239 as measured and the amount of the second taggant 234 in the produced stream 239 as measured. Determining the water cut of the first production zone or the second production zone includes using the following equation:

$$T_{oil(i)} \approx e^{-aQ_i t}$$

wherein $T_{oil(i)}$ is the tracer concentration in oil from a specified production zone, a is a geometrical constant of an annular completion region approximately equal to 1/V, where V is the volume of the annular region from the mouth of the dosing line up to the mouth of the inflow control valve, $Q_i$ is a total oil production flow rate from the specified production zone, and t is time.

In summary, selectively soluble taggants (e.g., the aforementioned oil-soluble tracers) are injected from the surface via dosing lines into different sections or zones of a multi-lateral well. These taggants are designed to mark different fluid phases produced from each zone and be carried by the produced oil and water to the surface. Their concentrations measured at the surface—specifically, how their concentrations decrease over time after dosing is shut off—allow for the computation of the oil producing rates from each zone. As mentioned, a carrier fluid may promote or advance injection of the taggant via the dosing tubing from the surface into the different zones in the reservoir. For oil-soluble taggants, the carrier fluid may be crude oil, mineral oil, certain solvents (such as ethanol and chloroform), or any combinations of these.

Figure 4:
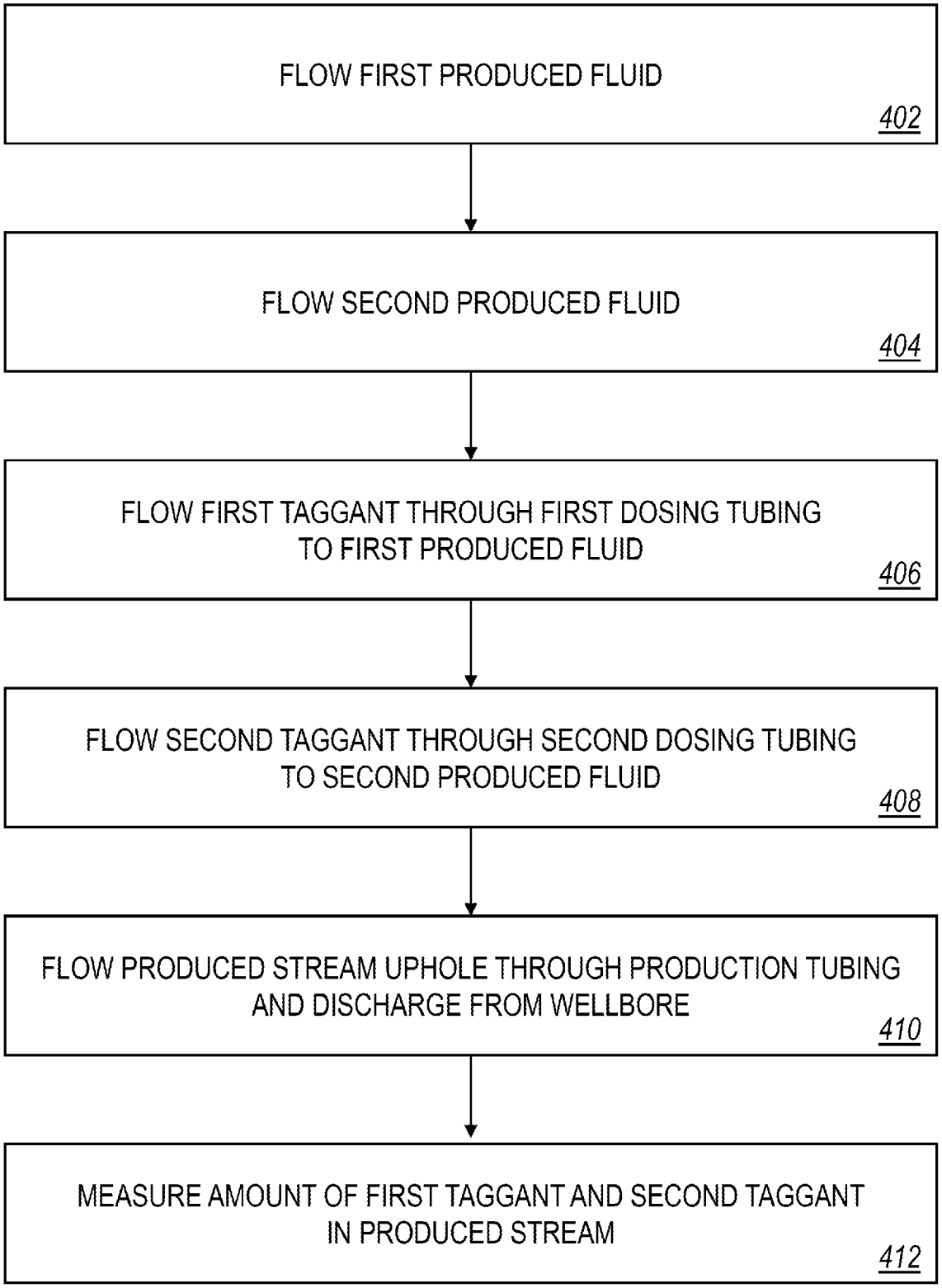
FIG. 4 is a flow chart of an example method of quantifying zonal flow in a multi-lateral well.

FIG. 4 is a flow chart of a method 400 of quantifying zonal flow in a multi-lateral well. Method 400 is substantially similar to the method 300. At block 402, a first produced fluid (such as the first produced fluid 236) is flowed from a subterranean formation (such as the formation 204) via a first lateral (such as the lateral 206) in a wellbore (such as the wellbore 200) of the multi-lateral well through a first valve (such as the valve 224) into a production tubing (such as the production tubing 216) in the wellbore 200. At block 404, a second produced fluid (such as the second produced fluid 238) is flowed from the formation 204 via a second lateral (such as the lateral 208) in the wellbore 200 through a second valve (such as the valve 226) into the production tubing 216. At block 406, a first taggant (such as the taggant 232) is flowed through a first dosing tubing (such as the tubing 228) in the wellbore 200 to the first produced fluid 236 in the first lateral 206 to mix with the first produced fluid 236 prior to the first produced fluid 236 flowing through the first valve 224 into the production tubing 216 at block 402. At block 408, a second taggant (such as the taggant 234) is flowed through a second dosing tubing (such as the tubing 230) in the wellbore 200 to the second produced fluid 238 in the second lateral 208 to mix with the second produced fluid 238 prior to the second produced fluid 238 flowing through the second valve 226 into the production tubing 216 at block 404. At block 410, a produced stream (such as the produced stream 239) that includes the first produced fluid 236 and the second produced fluid 238 is flowed uphole through the production tubing 216 and discharged from the wellbore 200. At block 412, an amount (first-taggant amount) of the first taggant 232 and an amount (second-taggant amount) of the second taggant 234 in the produced stream 239 are measured. Measuring the amounts of the first taggant 232 and the second taggant 234 at block 412 can include analytical techniques (instruments), such as ultraviolet (UV)-vis spectroscopy, fluorescence spectroscopy, X-ray fluorescence (XRF), inductively coupled plasma (ICP) spectroscopy, and/or ICP spectroscopy-mass spectroscopy (MS), and the like. The XRF analysis at block 412 can include exposing the produced stream 239 to an X-ray, which causes the first taggant 232 and the second taggant 234 to fluoresce. The XRF analysis at block 412 can include measuring a fluorescence of the first taggant 232 and a fluorescence of the second taggant 234. The XRF analysis at block 412 can include determining the amount (first-taggant amount) of the first taggant 232 in the produced stream 239 and the amount (second-taggant amount) of the second taggant 234 in the produced stream 239 based on the measured fluorescence of the first taggant 232 and the measured fluorescence of the second taggant 234, respectively. Similarly as method 300, production of fluid (for example, the produced stream 239) from the multi-lateral well proceeds without ceasing throughout method 400.

Figure 5:
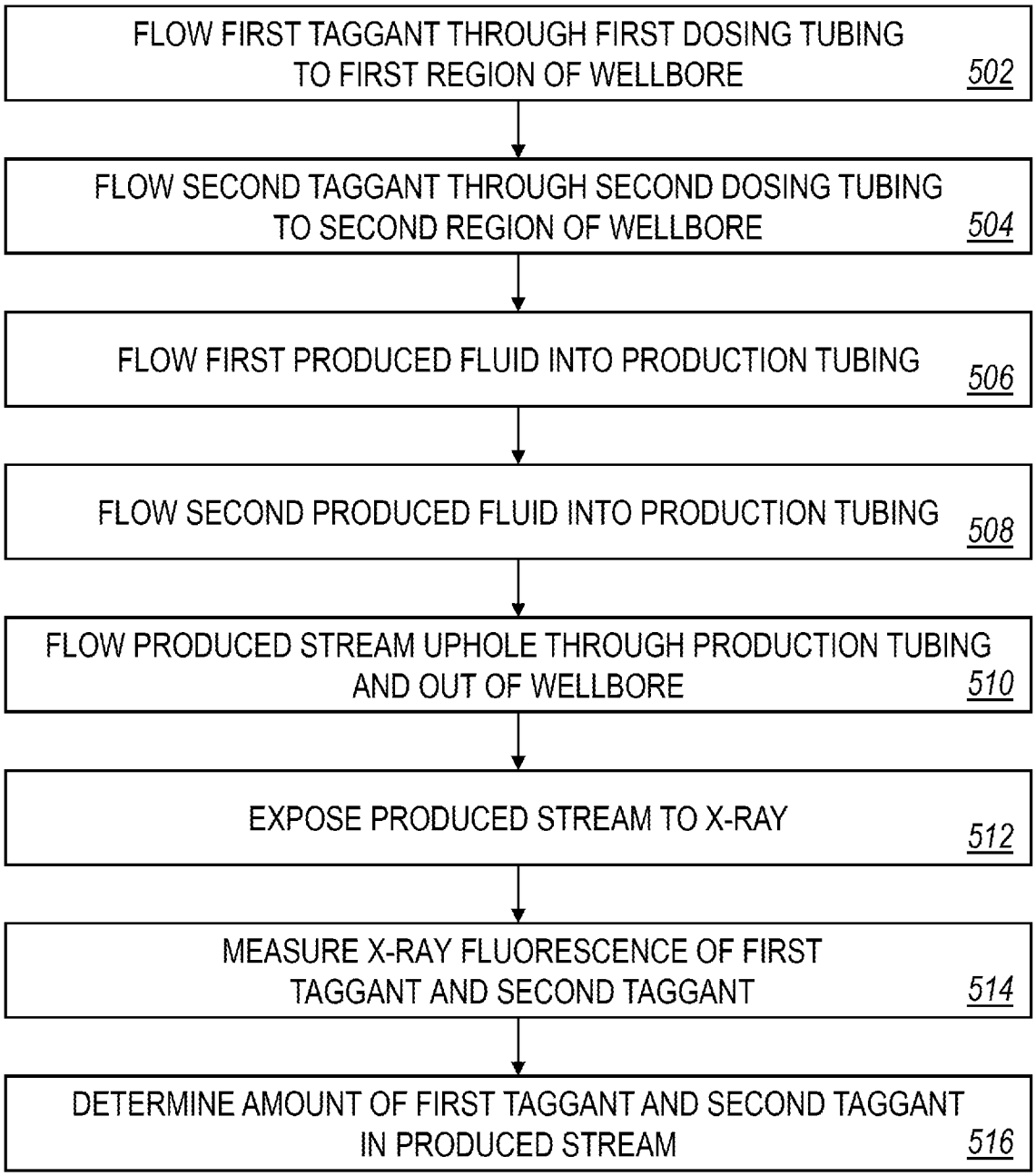
FIG. 5 is a flow chart of an example method of quantifying zonal flow in a multi-lateral well.
Figure 6A:
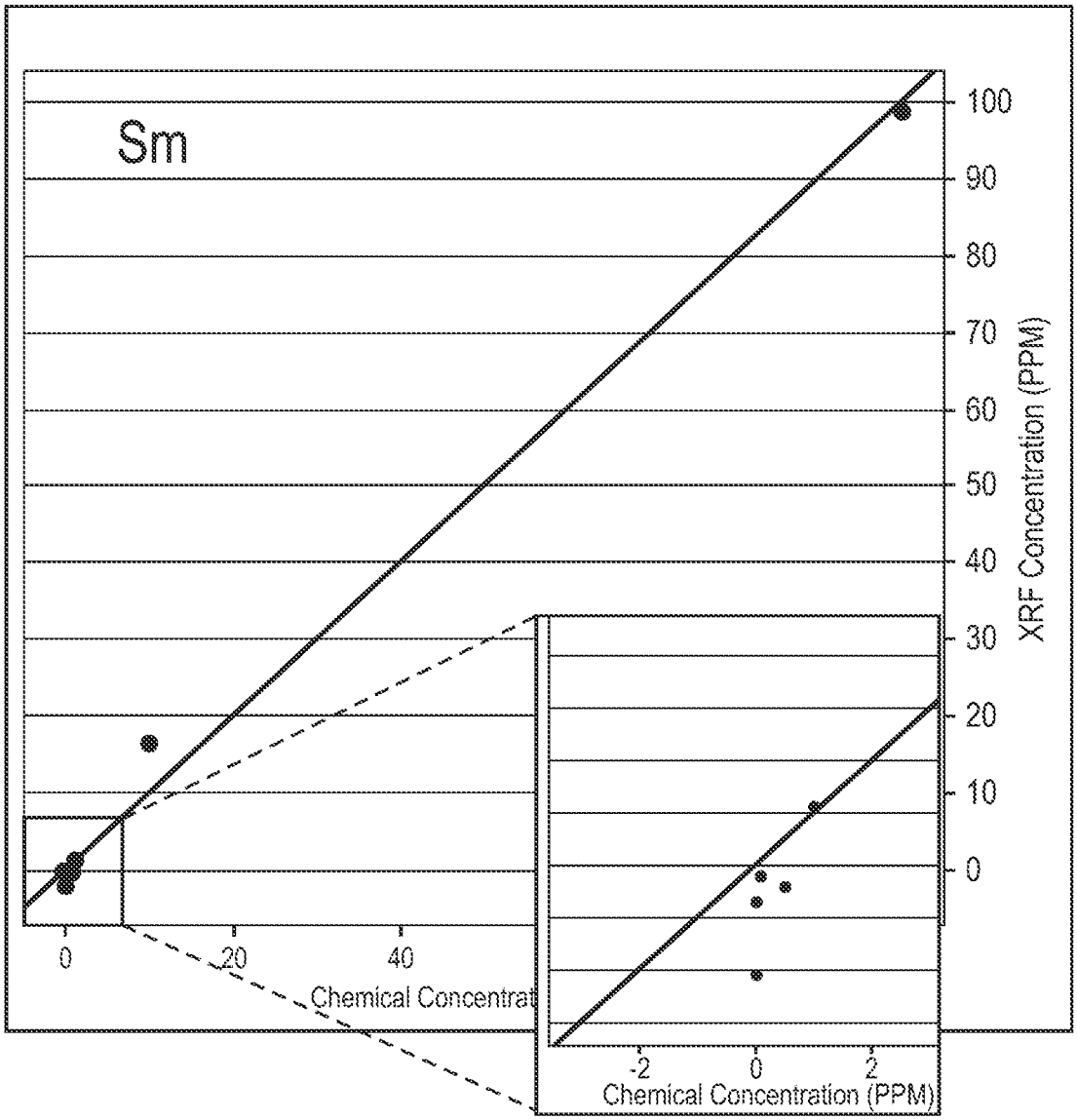
FIG. 6A is a standard curve for samarium (Sm) ions in an ethanol/chloroform mixture.
Figure 6B:
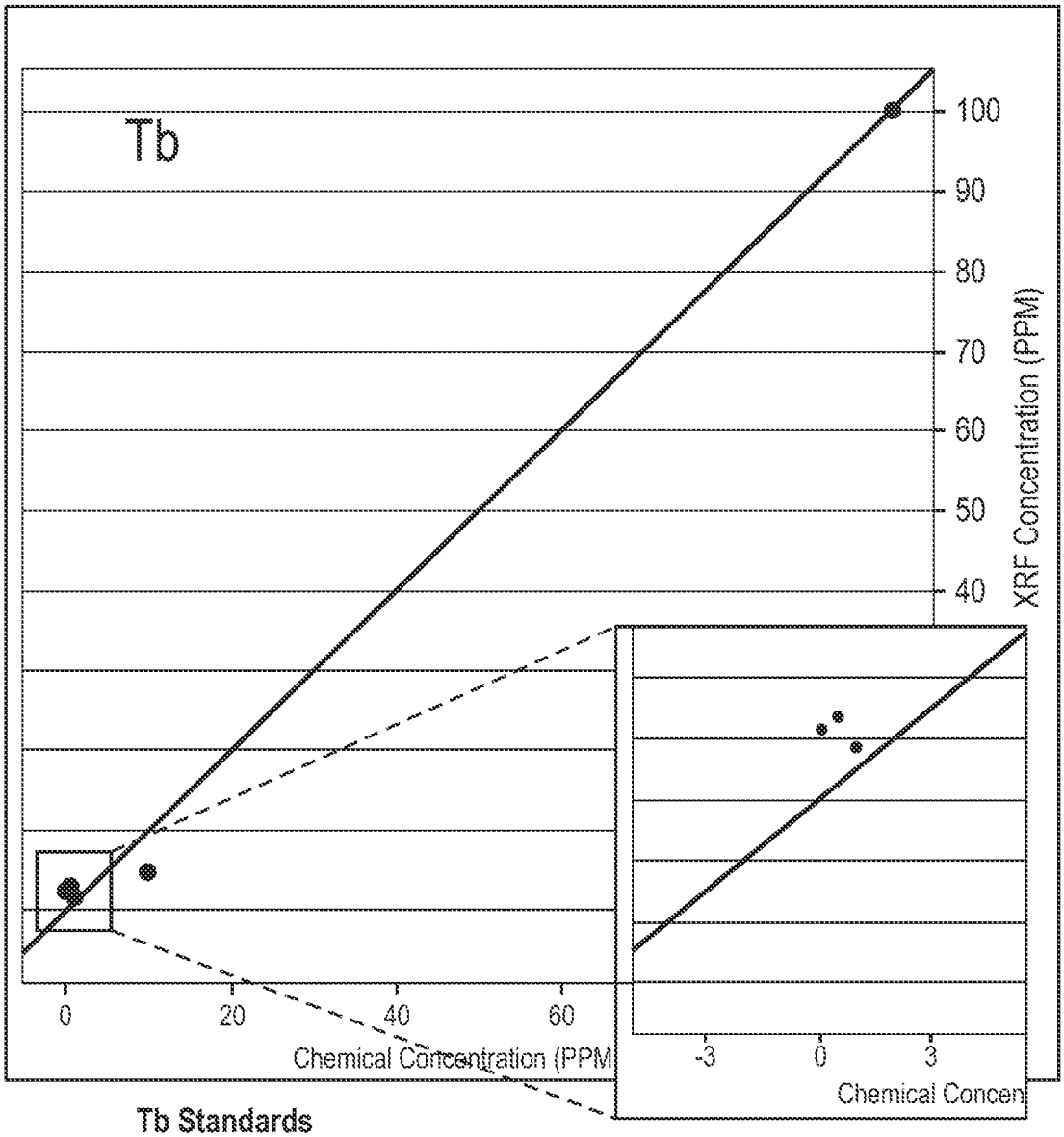
FIG. 6B is a standard curve for terbium (Tb) ions in an ethanol/chloroform mixture.
Figure 6C:
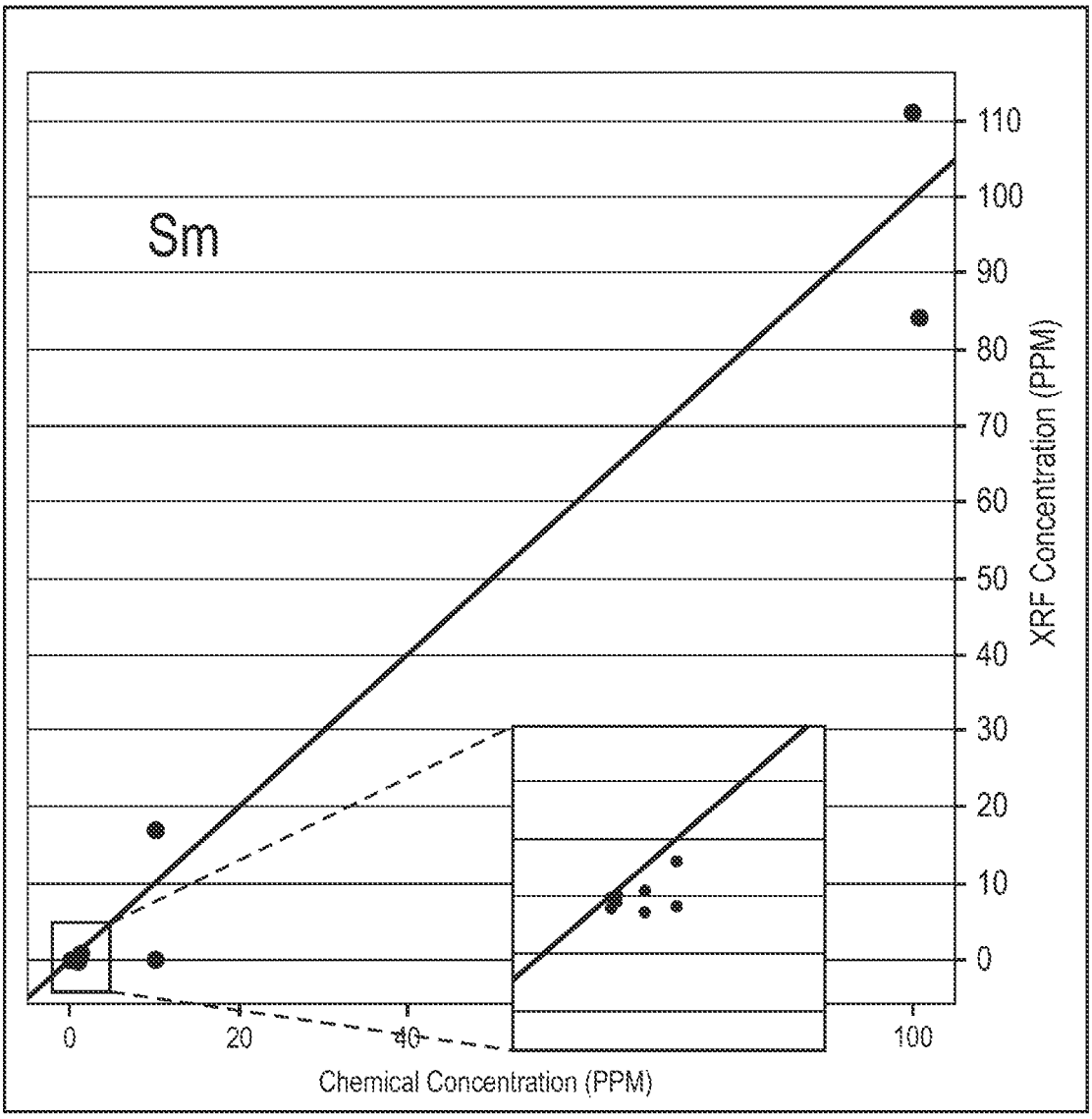
FIG. 6C is a standard curve for Sm ions in crude oil.
Figure 6D:
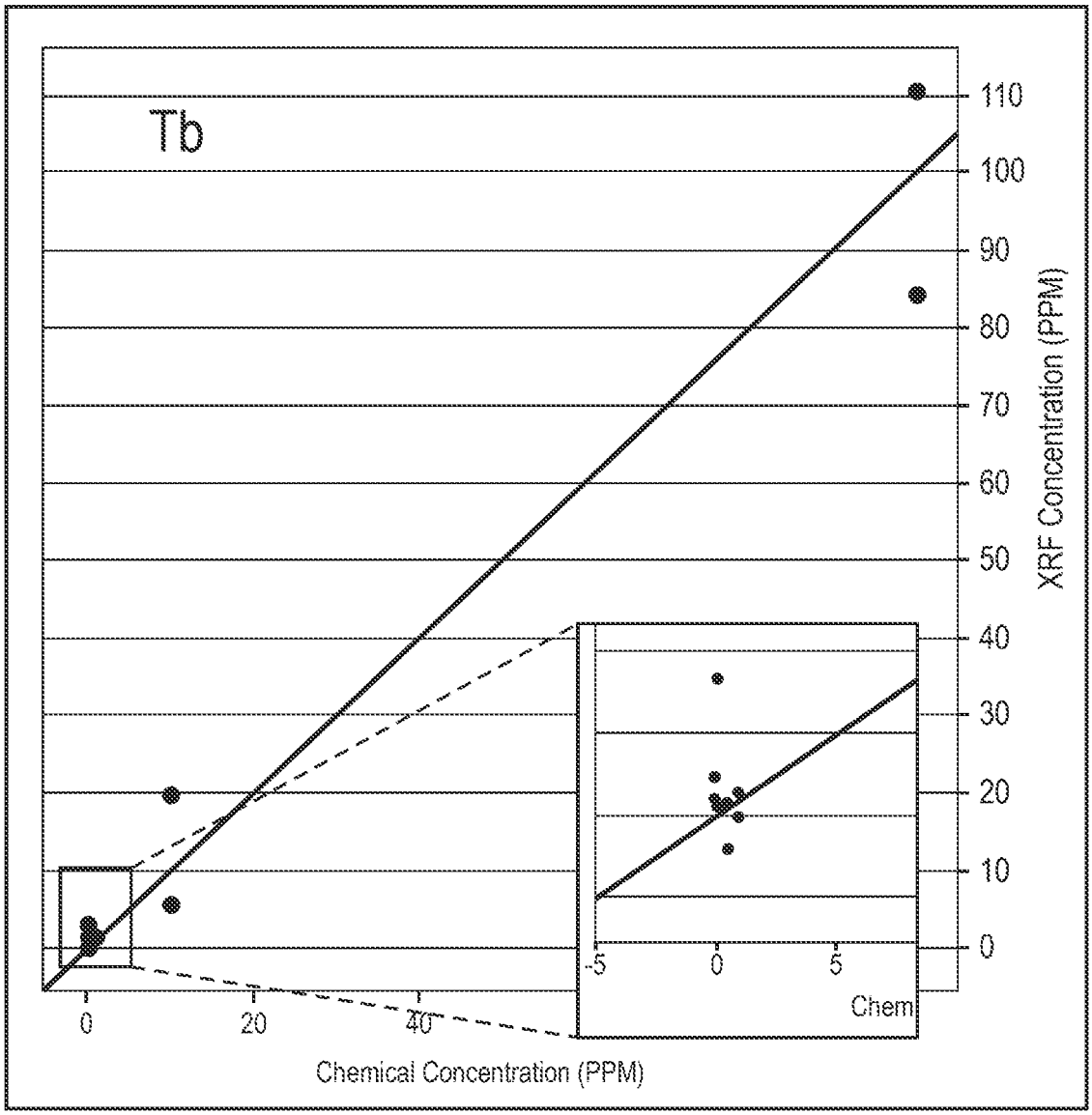
FIG. 6D is a standard curve for Tb ions in crude oil.

FIG. 5 is a flow chart of a method 500 of quantifying zonal flow in a multi-lateral well. Method 500 is substantially similar to the methods 300 and 400. At block 502, a first taggant (such as the taggant 232) is flowed from the surface of the Earth (such as the surface 202) through a first dosing tubing (such as the tubing 228) to a first region of a wellbore (such as the wellbore 200) of the multi-lateral well. The first region is a region of intersection of a first lateral (such as the lateral 206) of the multi-lateral well with a vertical portion of the wellbore 200. At block 504, a second taggant (such as the taggant 234) is flowed from the surface 202 through a second dosing tubing (such as the tubing 230) to a second region of the wellbore 200. The second region is a region of intersection of a second lateral (such as the lateral 208) of the multi-lateral well with the vertical portion of the wellbore 200. At block 506, a first produced fluid (such as the first produced fluid 236), which includes the first taggant 232 that was flowed to the first region at block 502, is flowed from the formation (such as the formation 204) through the first lateral 206 into a production tubing (such as the production tubing 216) in the wellbore 200. At block 508, a second produced fluid (such as the second produced fluid 238), which includes the second taggant 234 that was flowed to the second region at block 504, is flowed from the formation 204 through the second lateral 208 into the production tubing 216. At block 510, a produced stream (such as the produced stream 239) that includes the first produced fluid 236 and the second produced fluid 238 is flowed uphole through the production tubing 216 out of the wellbore 200. At block 512, the produced stream 239 is exposed to an X-ray, which causes the first taggant 232 and the second taggant 234 to fluoresce. At block 514, a fluorescence of the first taggant 232 and a fluorescence of the second taggant 234 are measured. At block 516, an amount (first-taggant amount) of the first taggant 232 and an amount (second-taggant amount) of the second taggant 234 in the produced stream 239 are determined based on the fluorescence of the first taggant 232 and the fluorescence of the second taggant 234, respectively, measured at block 514. Similarly as methods 300 and 400, production of fluid (for example, the produced stream 239) from the multi-lateral well proceeds without ceasing throughout method 500.

EXAMPLES

Examples 1 and 2 are presented. Examples 1 and 2 are given only as examples and are not intended to limit the present techniques.

Example 1

Samples of terbium (III) acetylacetonate (Tb) and samarium (III) 2,4-pentanedionate hydrate (Sm) in crude oil at various concentrations were prepared for XRF analysis to determine their limits of detection (LOD). Because of the high solubility of Tb and Sm in ethanol, the samples were prepared by first dissolving the Tb and Sm in ethanol, mixed with chloroform, and then dissolved in crude oil. Various standard solutions and a crude oil reference sample were prepared. Sm standard solutions having concentrations of 100 parts per billion (ppb), 500 ppb, 1 part per million (ppm), 10 ppm, and 100 ppm were each prepared in 10 milliliter (mL) mixtures of ethanol and chloroform (1:1 ratio of ethanol:chloroform). Tb standard solutions having concentrations of 100 ppb, 500 ppb, 1 ppm, 10 ppm, and 100 ppm were each prepared in 10 mL mixtures of ethanol and chloroform (1:1 ratio of ethanol:chloroform). Sm and Tb mixture standard solutions having concentrations of 100 ppb, 500 ppb, 1 ppm, 10 ppm, and 100 ppm were each prepared in 10 mL of crude oil. The crude oil reference sample had a volume of 10 mL.

Each of the standard solutions and reference sample (16 total) were measured by Bruker S2 PUMA Series 2, ThermoFisher ARL Quant'x XRF spectrometer (benchtop) system and Bruker S8 TIGER Series 2 XRF (regular) system. FIGS. 6A, 6B, 6C, and 6D are the standard curves for Sm in ethanol/chloroform, Tb in ethanol/chloroform, Sm in crude oil, and Tb in crude oil, respectively, based on the XRF signals measured by the S2 PUMA system. The LODs were determined to be 1 ppm for Sm in ethanol/chloroform, 10 ppm for Tb in ethanol/chloroform, 1 ppm for Sm in crude oil, and 10 ppm for Tb in crude oil.

Figure 7A:
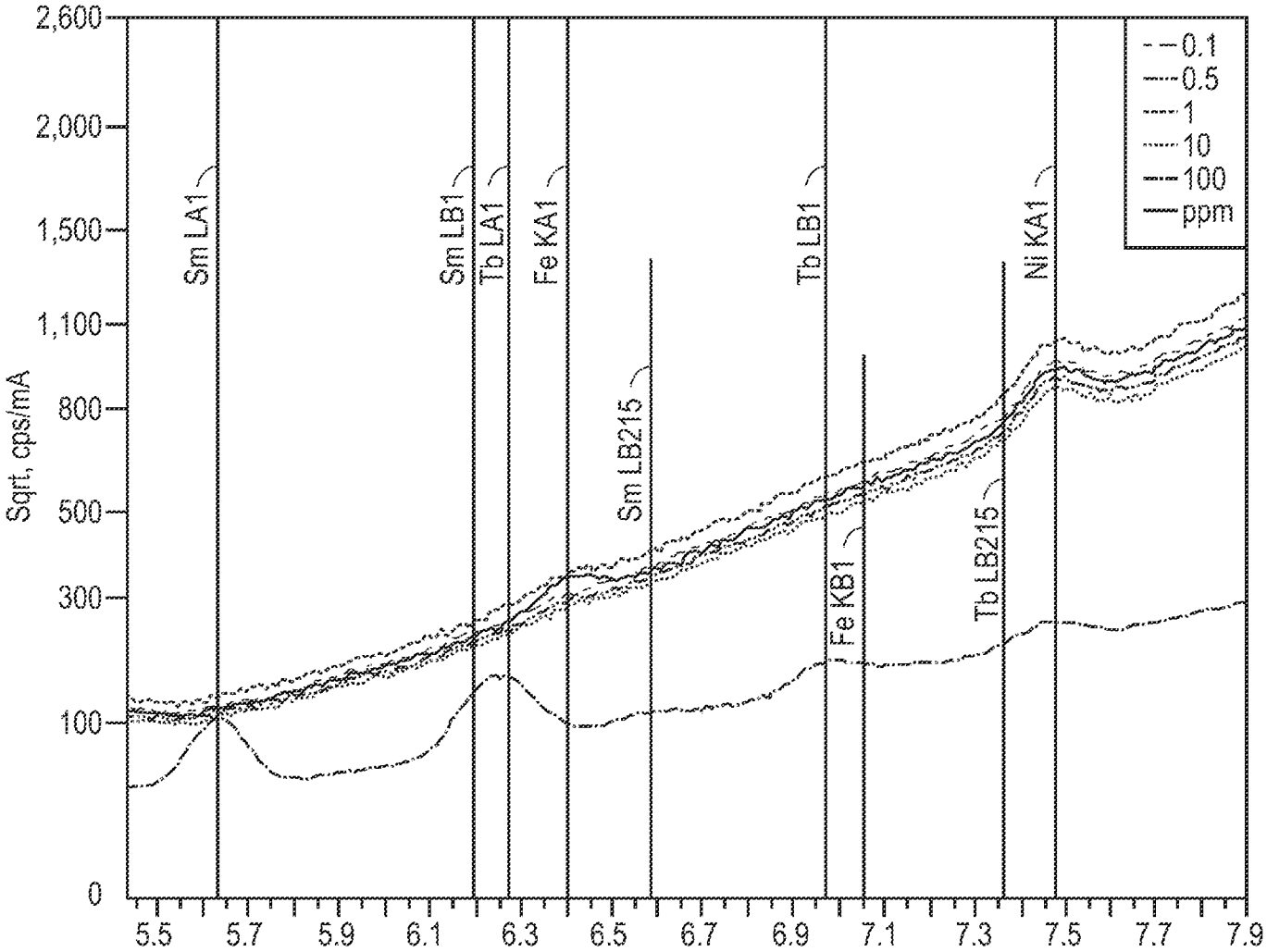
FIG. 7A is an X-ray fluorescence (XRF) spectra of a Sm and Tb mixture in crude oil.
Figure 7B:
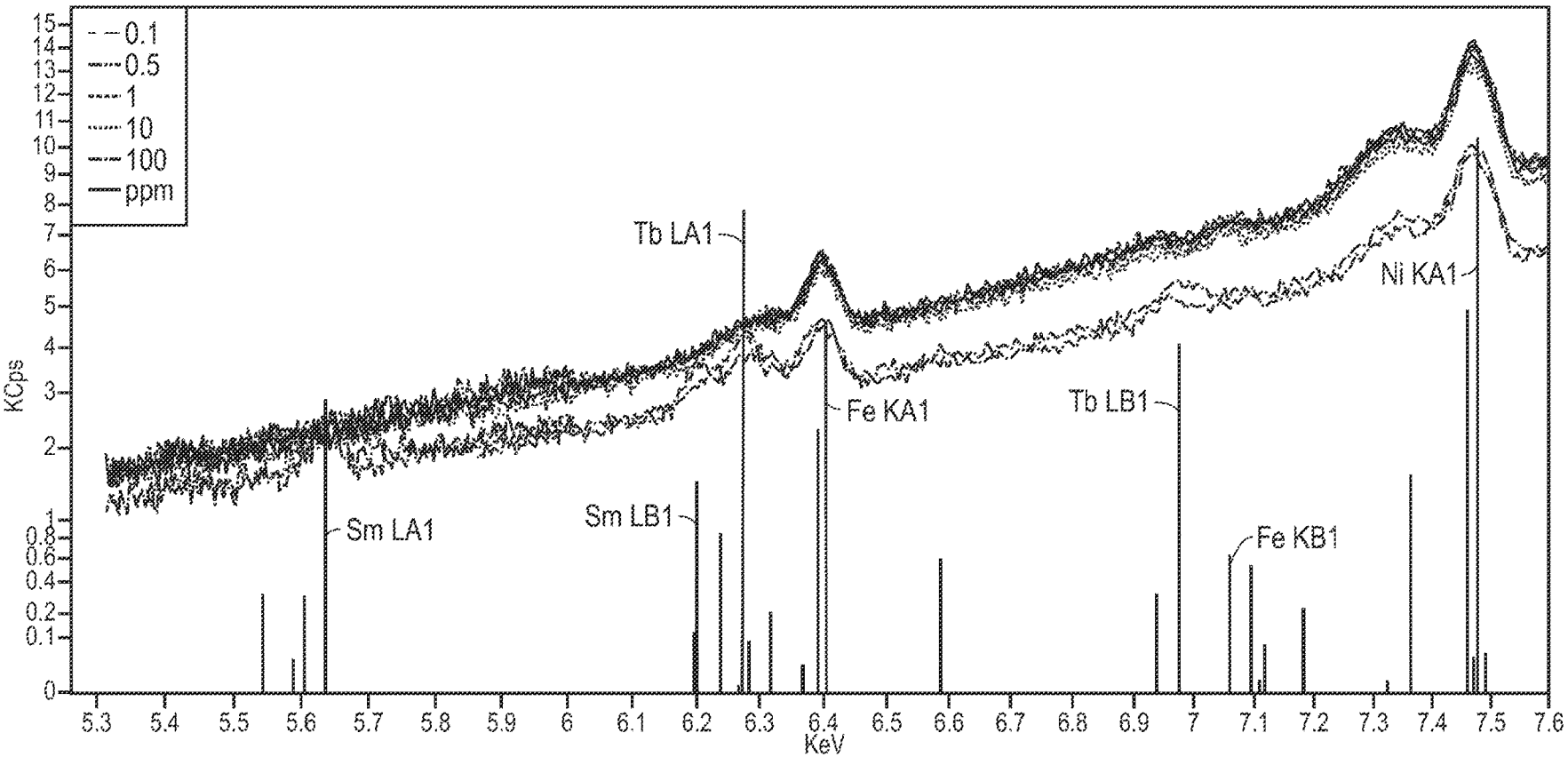
FIG. 7B is an XRF spectra of a Sm and Tb mixture in crude oil.

FIG. 7A shows the XRF spectra of the Sm and Tb mixtures in crude oil measured by the S2 PUMA system. It was difficult to identify signals below concentrations of 10 ppm for both Sm and Tb ions, which was likely due to the crude oil matrix background signals. FIG. 7B shows the XRF spectra of the Sm and Tb mixtures in crude oil measured by the S8 TIGER system. No peaks for the samples having concentrations of 10 ppm or less were identified with the S8 TIGER system even though Sm and Tb ions were clearly resolved with the 100 ppm sample in crude oil. To improve these results, lanthanides chelated with more hydrophobic ligands or other transient metals (such as Zn, Cu, etc.), where are not present in crude oil. Other ligands, such as sulfur, chlorine, iron, vanadium are to be considered and tested.

Example 2

Samples of terbium nitrate (Tb), samarium nitrate (Sm), cobalt nitrate (Co), and manganese (II) nitrate (Mn) were dissolved in ethanol, mixed with octadenoic acid (stearic acid) in chloroform, and then extracted into an oil phase (chloroform). Samples of Tb, Sm, Co, and Mn ions in crude oil at various concentrations were prepared for XRF analysis to determine their LODs. Sm standard solutions having concentrations of 5 ppm, 10 ppm, 50 ppm, and 100 ppm in crude oil were prepared. Tb standard solutions having concentrations of 5 ppm, 10 ppm, 50 ppm, and 100 ppm in crude oil were prepared. Co standard solutions having concentrations of 5 ppm and 100 ppm in crude oil were prepared. Mn standard solutions having concentrations of 5 ppm and 100 ppm in crude oil were prepared.

Figure 8A:
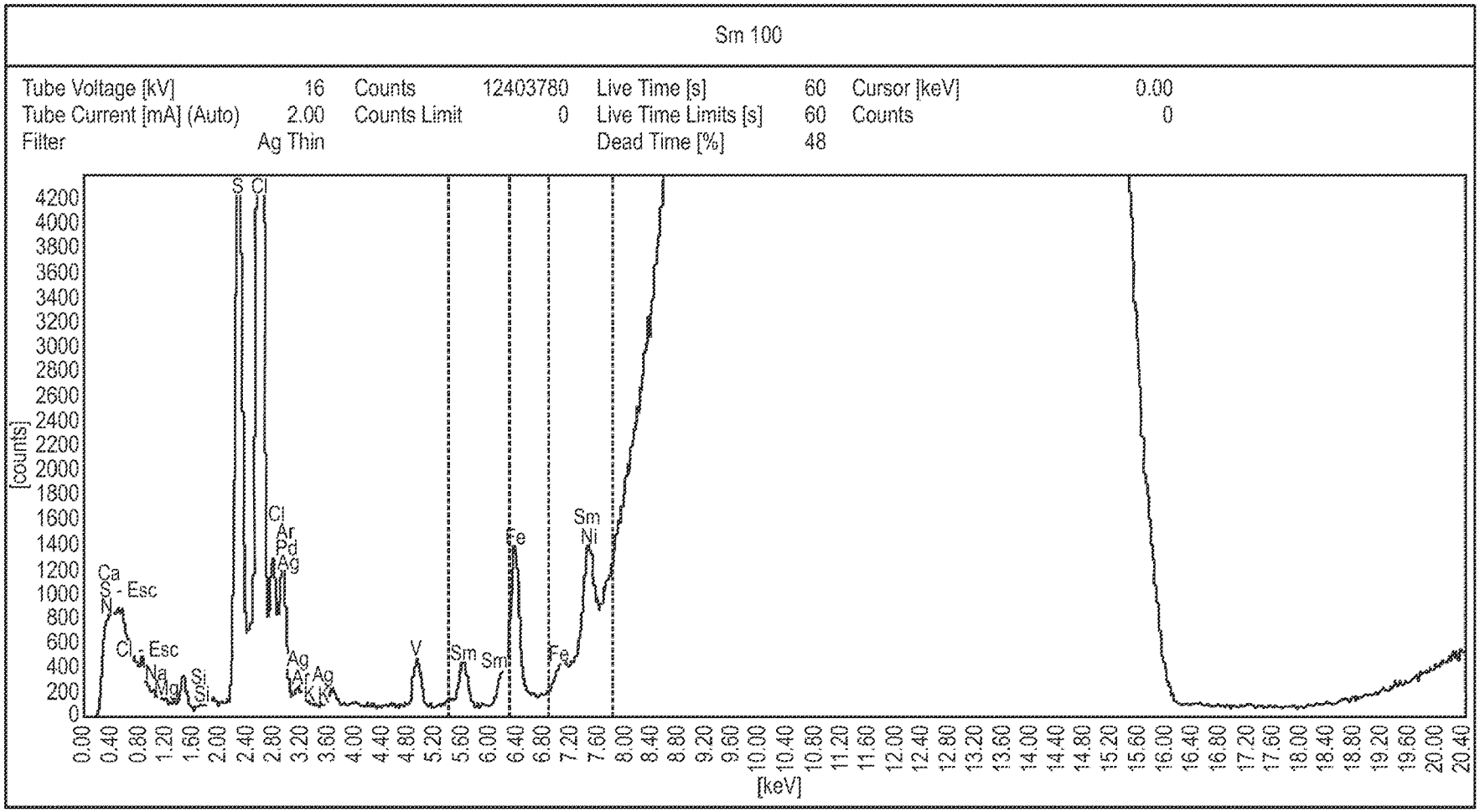
FIG. 8A is an XRF spectra of Sm in crude oil.
Figure 8B:
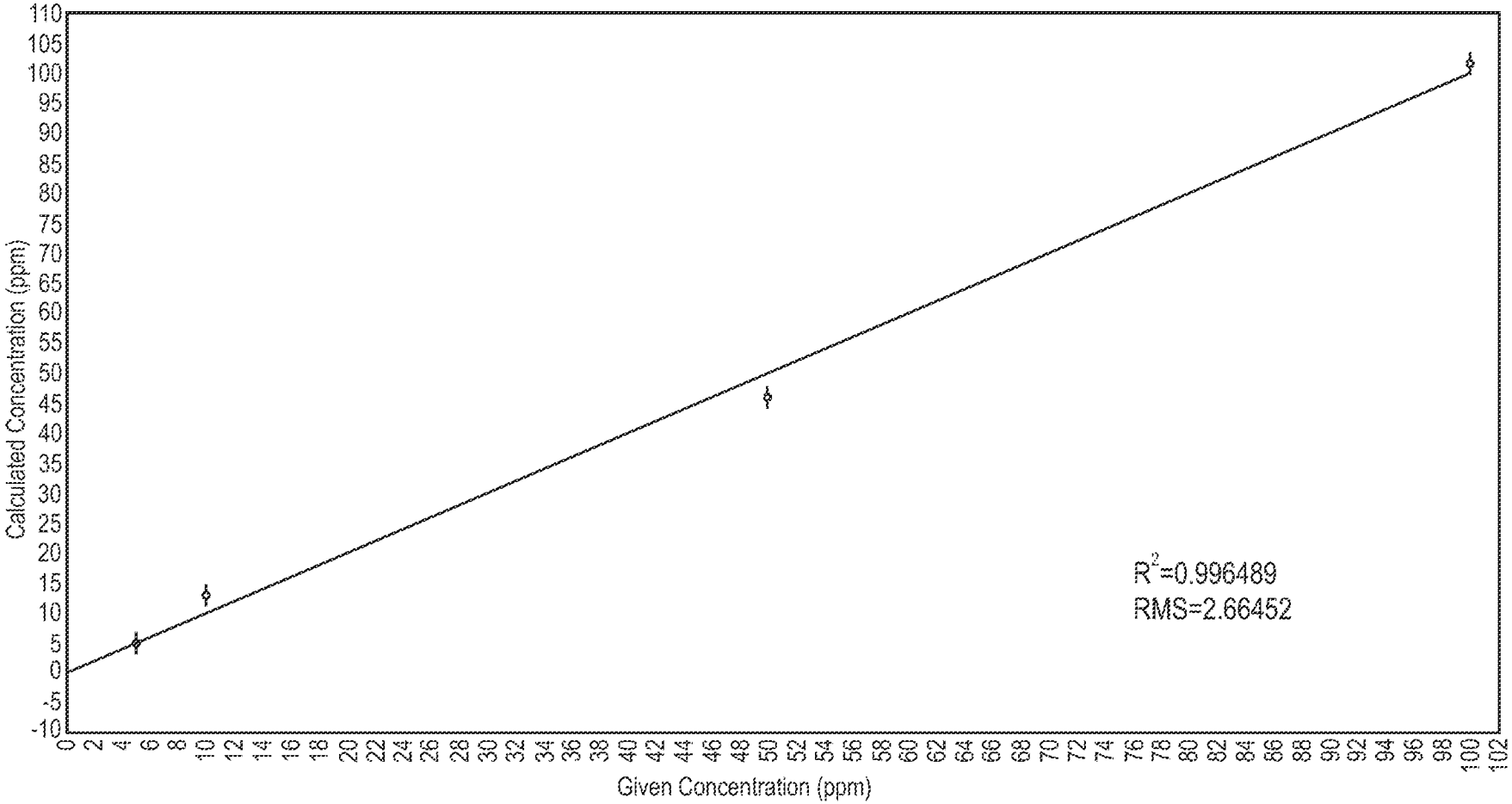
FIG. 8B is a standard curve of Sm in crude oil.

FIG. 8A shows the XRF spectra of Sm in crude oil using the ARL Quant'x XRF spectrometer. FIG. 8B shows the standard curve for Sm in crude oil. Based on the XRF signals of the Sm ions in the crude oil measured by the ARL Quant'x XRF spectrometer (FIG. 8A), the standard curves were plotted (FIG. 8B), and signals from about 5 ppm and greater of Sm in crude oil could be clearly observed.

Figure 9A:
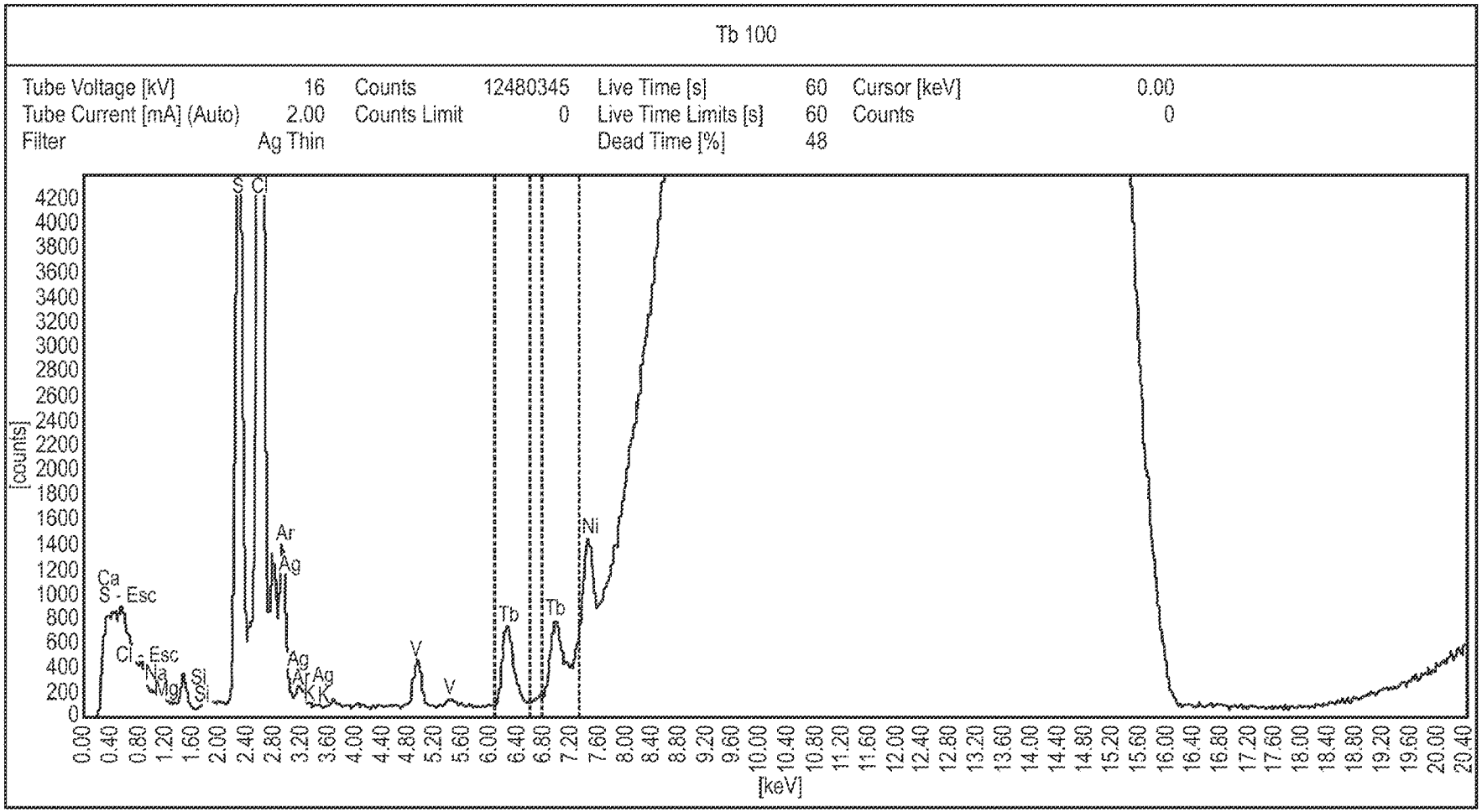
FIG. 9A is an XRF spectra of Tb in crude oil.
Figure 9B:
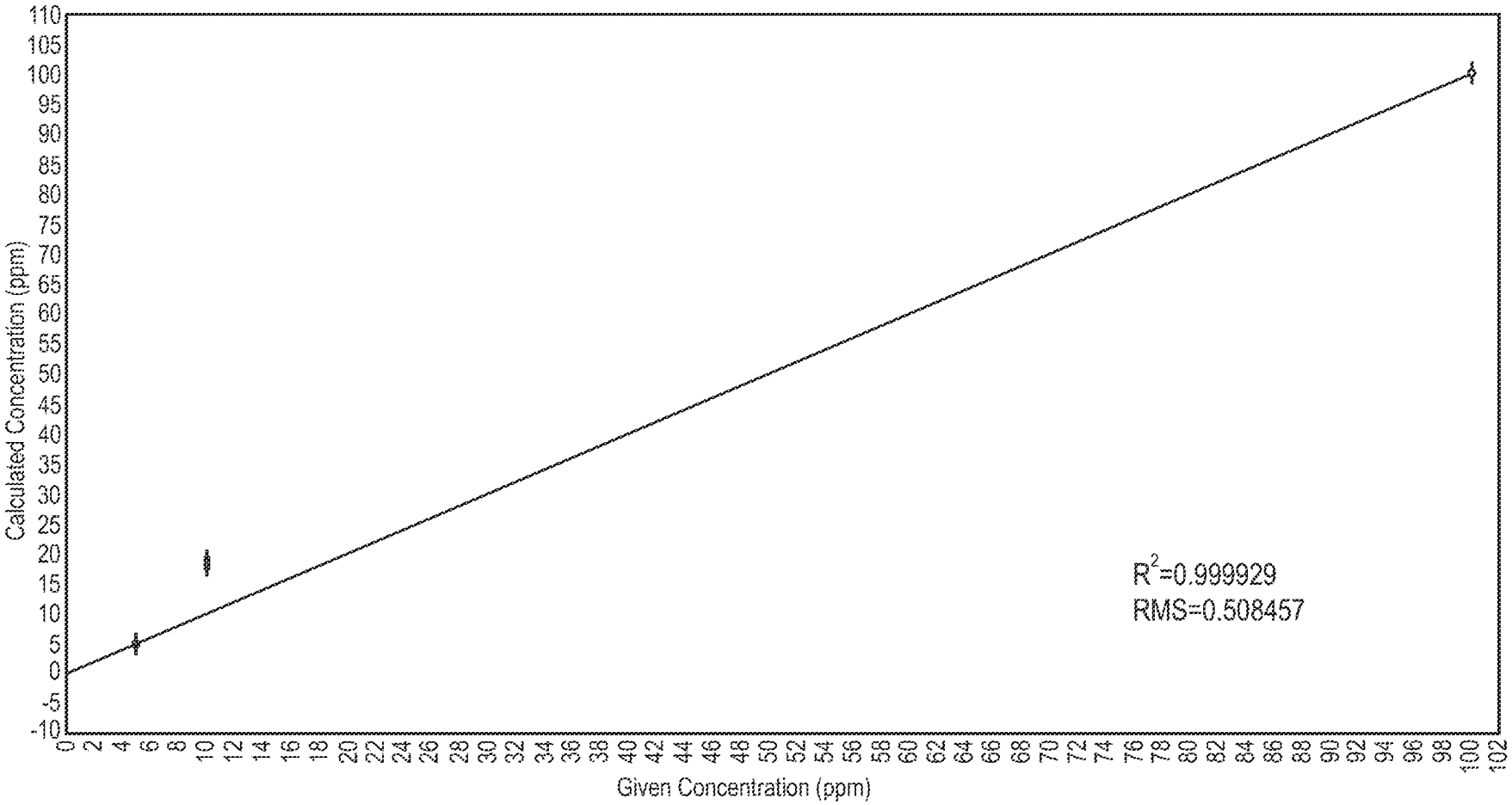
FIG. 9B is a standard curve of Tb in crude oil.

FIG. 9A shows the XRF spectra of Tb in crude oil using the ARL Quant'x XRF spectrometer. FIG. 9B shows the standard curve for Tb in crude oil. Based on the XRF signals of the Tb ions in the crude oil measured by the ARL Quant'x XRF spectrometer (FIG. 9A), the standard curves were plotted (FIG. 9B), and signals from about 5 ppm and greater of Tb in crude oil could be clearly observed.

Figure 10A:
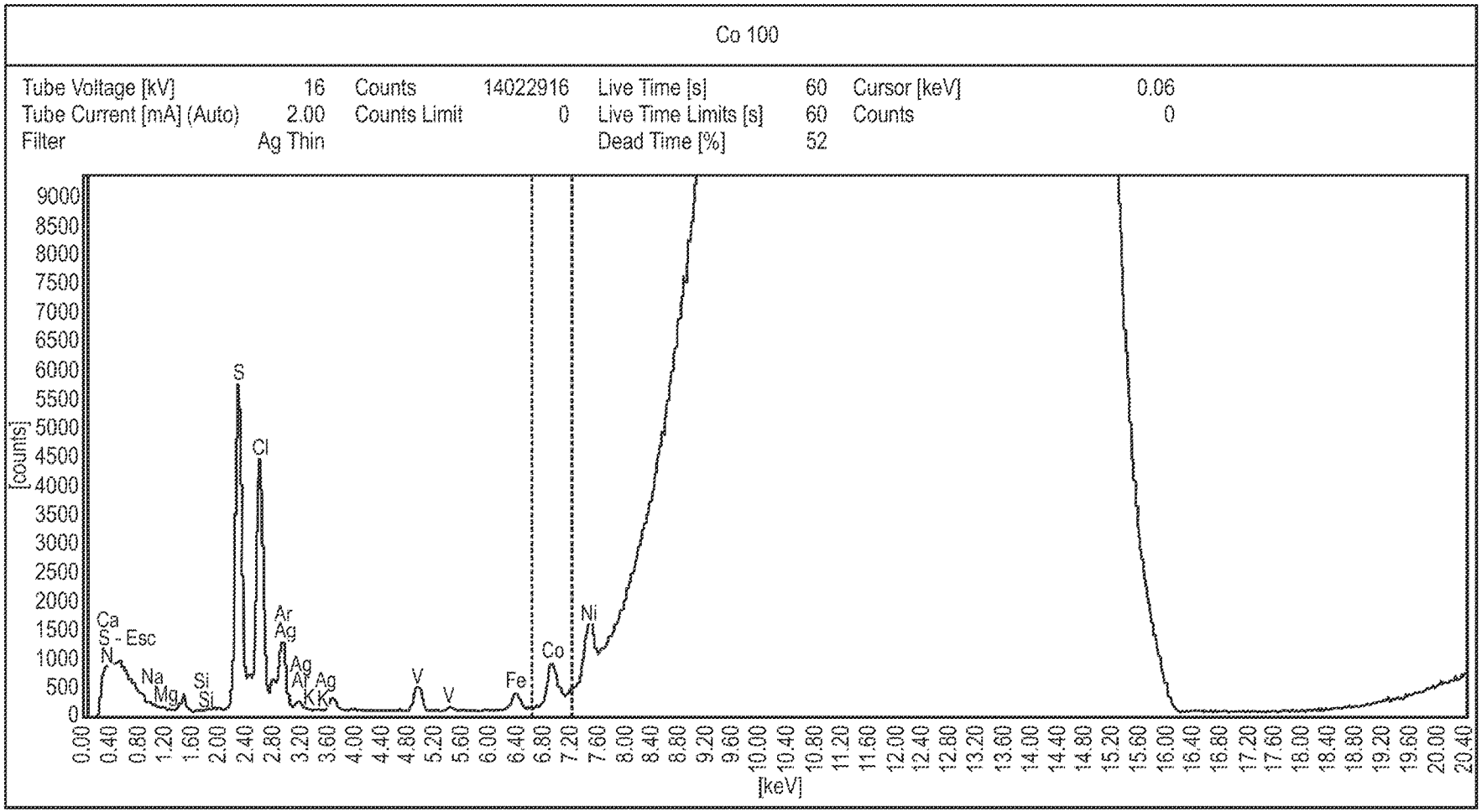
FIG. 10A is an XRF spectra of cobalt (Co) ions in crude oil.
Figure 10B:
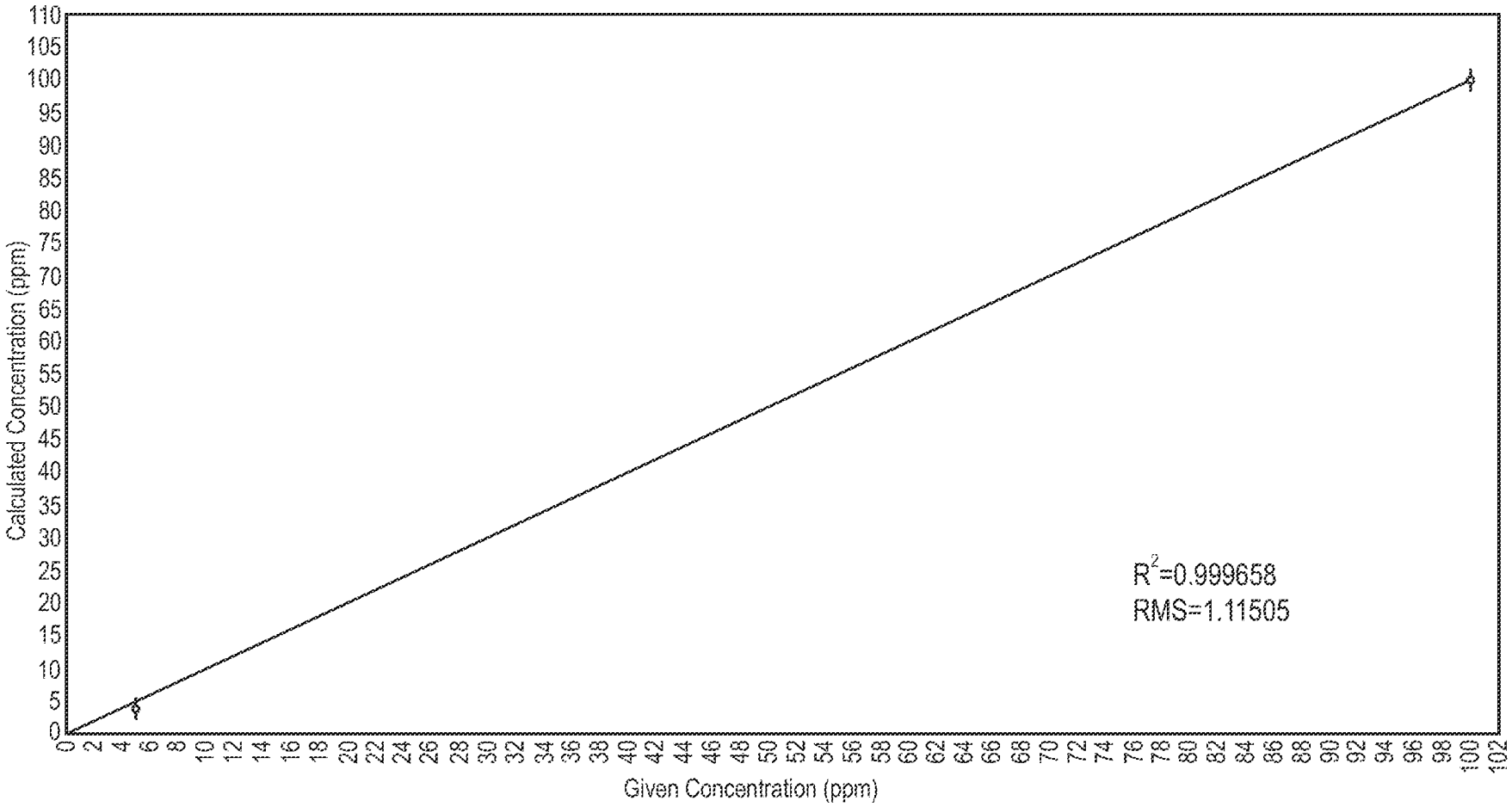
FIG. 10B is a standard curve of Co in crude oil.

FIG. 10A shows the XRF spectra of Co in crude oil using the ARL Quant'x XRF spectrometer. FIG. 10B shows the standard curve for Co in crude oil. Based on the XRF signals of the Co ions in the crude oil measured by the ARL Quant'x XRF spectrometer (FIG. 10A), the standard curves were plotted (FIG. 10B), and signals from about 5 ppm and greater of Co in crude oil could be clearly observed.

Figure 11A:
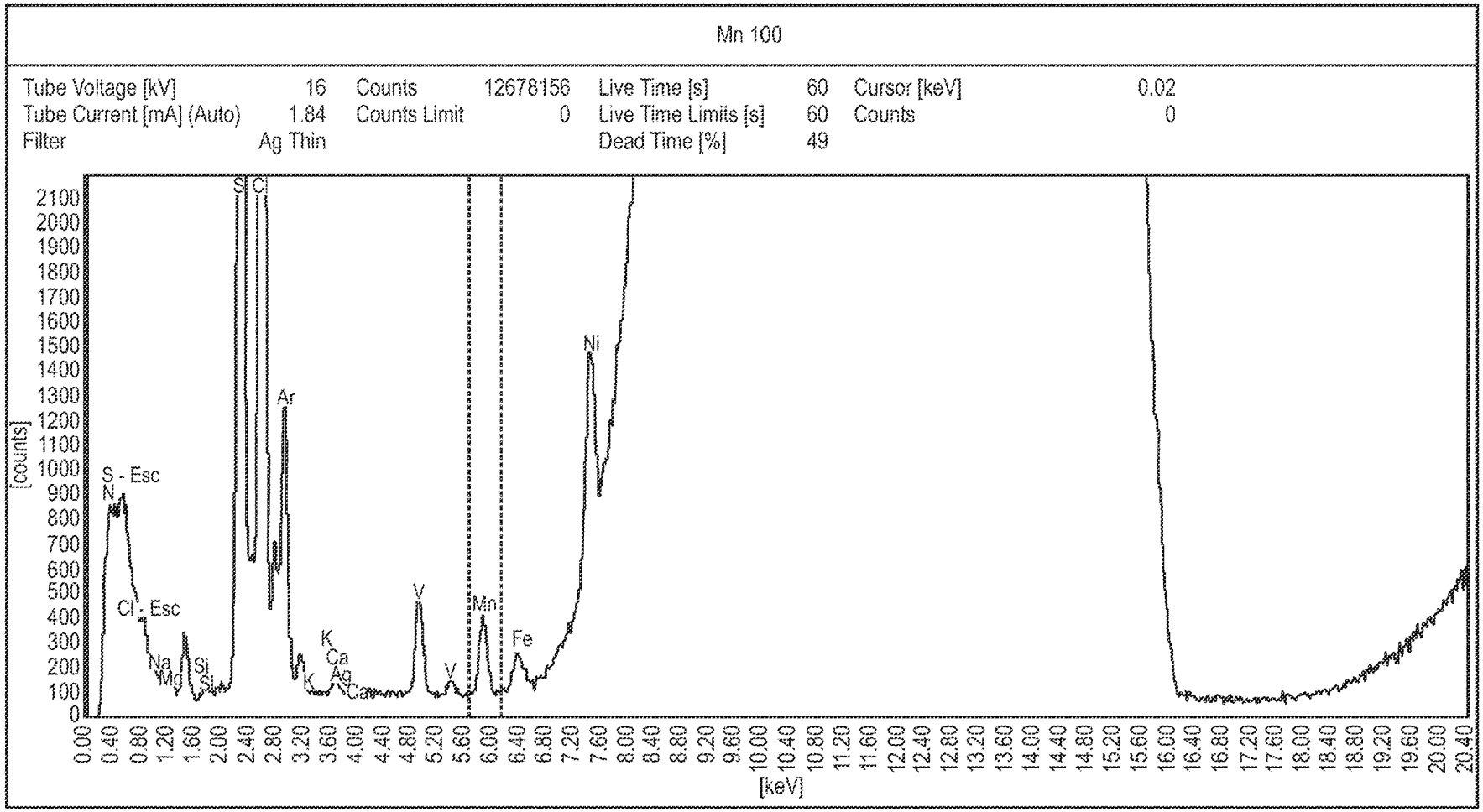
FIG. 11A is an XRF spectra of manganese (Mn) ions in crude oil.
Figure 11B:
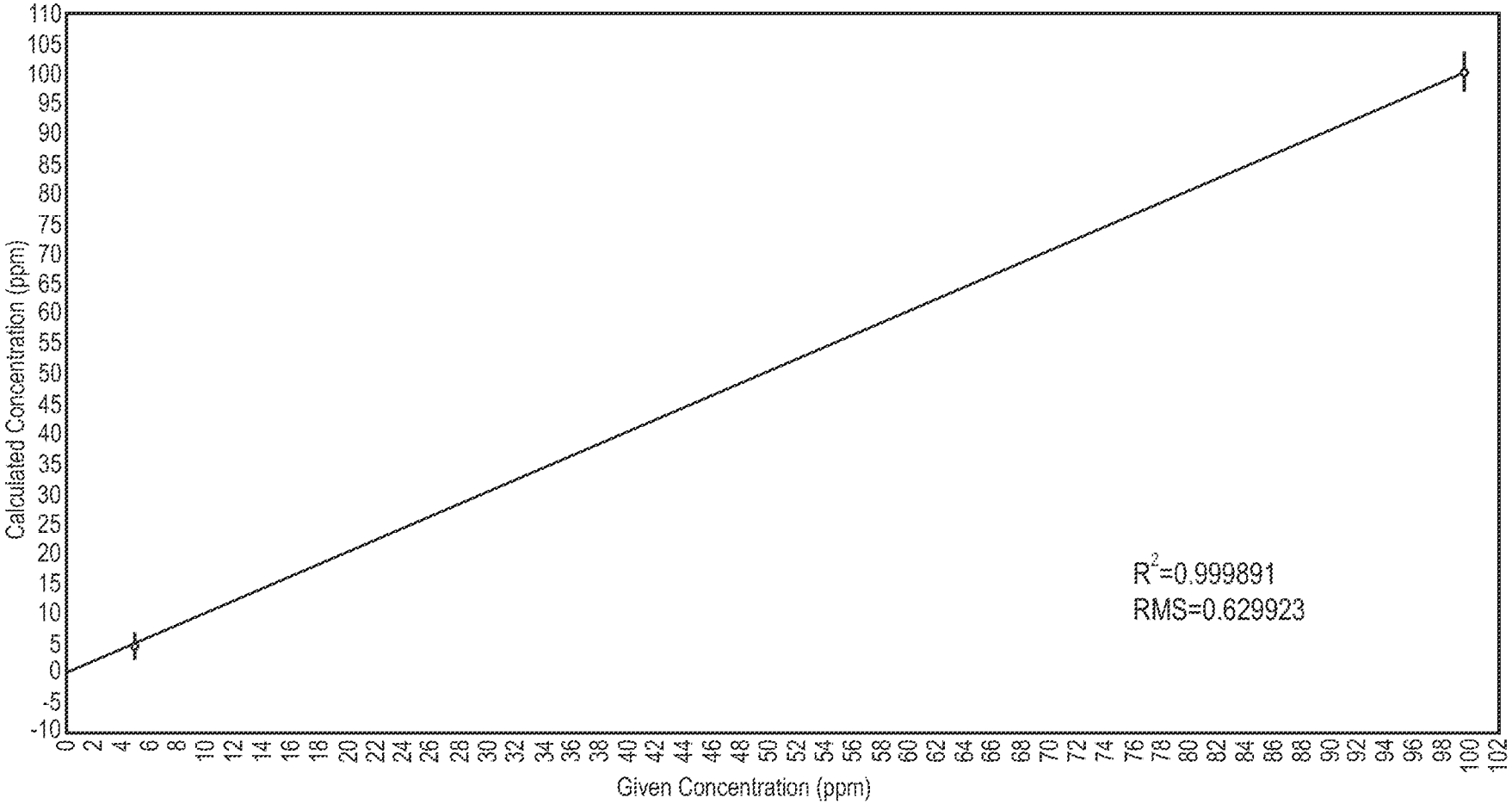
FIG. 11B is a standard curve of Mn in crude oil.

FIG. 11A shows the XRF spectra of Mn in crude oil using the ARL Quant'x XRF spectrometer. FIG. 11B shows the standard curve for Mn in crude oil. Based on the XRF signals of the Mn ions in the crude oil measured by the ARL Quant'x XRF spectrometer (FIG. 11A), the standard curves were plotted (FIG. 11B), and signals from about 5 ppm and greater of Mn in crude oil could be clearly observed.

EMBODIMENTS

In an example implementation (or aspect), a method of quantifying zonal flow in a multi-lateral well formed in a subterranean formation comprises: flowing a first produced fluid comprising hydrocarbon from the subterranean formation via a first lateral in a wellbore of the multi-lateral well through a first valve into a production tubing in the wellbore; flowing a second produced fluid comprising hydrocarbon from the subterranean formation via a second lateral in the wellbore through a second valve into the production tubing; flowing a first taggant through a first dosing tubing in the wellbore to the first produced fluid in the first lateral to mix with the first produced fluid prior to the first produced fluid flowing through the first valve into the production tubing; flowing a second taggant through a second dosing tubing in the wellbore to the second produced fluid in the second lateral to mix with the second produced fluid prior to the second produced fluid flowing through the second valve into the production tubing, wherein the first taggant and the second taggant are different from each other, wherein the first taggant and the second taggant are oil-soluble and each comprises a metal complexed with an oil-soluble ligand; flowing a produced stream comprising the first produced fluid and the second produced fluid uphole through the production tubing and discharging the produced stream from the wellbore; and measuring an amount of the first taggant and an amount of the second taggant in the produced stream, wherein production of fluid from the multi-lateral well proceeds without ceasing throughout the method.

In an example implementation (or aspect) combinable with any other example implementation (or aspect), measuring the amount of the first taggant and the amount of the second taggant in the produced stream comprises: exposing the produced stream to an X-ray, causing the first taggant and the second taggant to fluoresce; measuring a fluorescence of the first taggant and a fluorescence of the second taggant; and determining the amount of the first taggant and the amount of the second taggant in the produced stream based on the measured fluorescence of the first taggant and the measured fluorescence of the second taggant, respectively.

In an example implementation (or aspect) combinable with any other example implementation (or aspect), the method comprises determining an amount of the first produced fluid in the produced stream and an amount of second produced fluid in the produced stream based on the determined amount of the first taggant and the determined amount of the second taggant, respectively, in the produced stream.

In an example implementation (or aspect) combinable with any other example implementation (or aspect), the first taggant is flowed through the first dosing tubing with a first carrier fluid; the first taggant has a concentration in a range of from about 10,000 parts per million (ppm) to 100,000 ppm in the first carrier fluid; the second taggant is flowed through the second dosing tubing with a second carrier fluid; and the second taggant has a concentration in a range of from about 10,000 ppm to 100,000 ppm in the second carrier fluid.

In an example implementation (or aspect) combinable with any other example implementation (or aspect), the first carrier fluid and the second carrier fluid each comprises crude oil, mineral oil, ethanol, chloroform, or any combinations thereof.

In an example implementation (or aspect) combinable with any other example implementation (or aspect), the oil-soluble ligand of the first taggant and the second taggant is a salt of oleic acid (oleate) or stearic acid (stearate).

In an example implementation (or aspect) combinable with any other example implementation (or aspect), the metal of the first taggant and the second taggant is a rare earth metal or a transition metal, wherein the rare earth metal is selected from the group consisting of lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), or lutetium (Lu), wherein the transition metal is selected from the group consisting of cobalt (Co), manganese (Mn), nickel (Ni), or copper (Cu).

In an example implementation (or aspect) combinable with any other example implementation (or aspect), the first taggant and the second taggant are each selected from the group consisting of terbium (III) stearate, samarium (III) stearate, cobalt (II) stearate, manganese (II) stearate, terbium (III) oleate, samarium (III) oleate, cobalt (II) oleate, or manganese (II) oleate.

In an example implementation (or aspect), a method of quantifying zonal flow in a multi-lateral well formed in a subterranean formation comprises: flowing a first taggant through a first dosing tubing to a first region of a wellbore of the multi-lateral well, wherein the first region is associated with a first lateral of the multi-lateral well; flowing a second taggant through a second dosing tubing to a second region of the wellbore, wherein the second region is associated with a second lateral of the multi-lateral well, wherein the first taggant and the second taggant are different from each other, wherein the first taggant and the second taggant are oil-soluble and each comprises a metal complexed with an oil-soluble ligand; flowing a first produced fluid comprising the first taggant from the subterranean formation through the first lateral into a production tubing in the wellbore; flowing a second produced fluid comprising the second taggant from the subterranean formation through the second lateral into the production tubing; flowing a produced stream comprising the first produced fluid and the second produced fluid uphole through the production tubing and out of the wellbore; and measuring an amount of the first taggant and an amount of the second taggant in the produced stream, wherein production of fluid from the multi-lateral well proceeds without ceasing throughout the method.

In an example implementation (or aspect) combinable with any other example implementation (or aspect), the first region comprises an intersection of the first lateral with a vertical portion of the wellbore, the second region comprises an intersection of the second lateral with the vertical portion, and the production tubing is disposed in the vertical portion.

In an example implementation (or aspect) combinable with any other example implementation (or aspect), measuring the amount of the first taggant and the amount of the second taggant in the produced stream comprises: exposing the produced stream to an X-ray, causing the first taggant and the second taggant to fluoresce; measuring a fluorescence of the first taggant and a fluorescence of the second taggant; and determining the amount of the first taggant and the amount of the second taggant in the produced stream based on the measured fluorescence of the first taggant and the measured fluorescence of the second taggant, respectively.

In an example implementation (or aspect) combinable with any other example implementation (or aspect), the method comprises determining an amount of the first produced fluid in the produced stream and an amount of second produced fluid in the produced stream based on the determined amount of the first taggant and the determined amount of the second taggant, respectively, in the produced stream.

In an example implementation (or aspect) combinable with any other example implementation (or aspect), the first taggant is flowed through the first dosing tubing with a first carrier fluid; the first taggant has a concentration in a range of from about 10,000 parts per million (ppm) to 100,000 ppm in the first carrier fluid; the second taggant is flowed through the second dosing tubing with a second carrier fluid; and the second taggant has a concentration in a range of from about 10,000 ppm to 100,000 ppm in the second carrier fluid.

In an example implementation (or aspect) combinable with any other example implementation (or aspect), the first carrier fluid and the second carrier fluid each comprises crude oil, mineral oil, ethanol, chloroform, or any combinations thereof.

In an example implementation (or aspect) combinable with any other example implementation (or aspect), the oil-soluble ligand of the first taggant and the second taggant is a salt of oleic acid (oleate) or stearic acid (stearate).

In an example implementation (or aspect) combinable with any other example implementation (or aspect), the metal of the first taggant and the second taggant is a rare earth metal or a transition metal, wherein the rare earth metal is selected from the group consisting of lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), or lutetium (Lu), wherein the transition metal is selected from the group consisting of cobalt (Co), manganese (Mn), nickel (Ni), or copper (Cu).

In an example implementation (or aspect) combinable with any other example implementation (or aspect), the first taggant and the second taggant are each selected from the group consisting of terbium (III) stearate, samarium (III) stearate, cobalt (II) stearate, manganese (II) stearate, terbium (III) oleate, samarium (III) oleate, cobalt (II) oleate, or manganese (II) oleate.

In an example implementation (or aspect), a method of quantifying zonal flow in a multi-lateral well formed in a subterranean formation comprises: flowing a first taggant from the surface of the Earth through a first dosing tubing to a first region of a wellbore of the multi-lateral well, wherein the wellbore is formed through the surface into the subterranean formation, and the first region is a region of intersection of a first lateral of the multi-lateral well with a vertical portion of the wellbore; flowing a second taggant from the surface through a second dosing tubing to a second region of the wellbore, wherein the second region is a region of intersection of a second lateral of the multi-lateral well with the vertical portion, wherein the first taggant and the second taggant are different from each other, wherein the first taggant and the second taggant are oil-soluble and each comprises a metal complexed with an oil-soluble ligand; flowing a first produced fluid comprising the first taggant from the subterranean formation through the first lateral into a production tubing in the wellbore; flowing a second produced fluid comprising the second taggant from the subterranean formation through the second lateral into the production tubing; flowing a produced stream comprising the first produced fluid and the second produced fluid uphole through the production tubing and out of the wellbore; exposing the produced stream to an X-ray, causing the first taggant and the second taggant to fluoresce; measuring a fluorescence of the first taggant and a fluorescence of the second taggant; and determining an amount of the first taggant and an amount of the second taggant in the produced stream based on the measured fluorescence of the first taggant and the measured fluorescence of the second taggant, respectively, wherein production of fluid from the multi-lateral well proceeds without ceasing throughout the method.

In an example implementation (or aspect) combinable with any other example implementation (or aspect), the method comprises determining an amount of the first produced fluid in the produced stream and an amount of the second produced fluid in the produced stream based on the determined amount of the first taggant and the determined amount of the second taggant, respectively, in the produced stream.

In an example implementation (or aspect) combinable with any other example implementation (or aspect), the first taggant is flowed through the first dosing tubing with a first carrier fluid comprising crude oil, mineral oil, ethanol, chloroform, or any combinations thereof; the first taggant has a concentration in a range of from about 10,000 parts per million (ppm) to 100,000 ppm in the first carrier fluid; the second taggant is flowed through the second dosing tubing with a second carrier fluid comprising crude oil, mineral oil, ethanol, chloroform, or any combinations thereof; the second taggant has a concentration in a range of from about 10,000 ppm to 100,000 ppm in the second carrier fluid; and the first taggant and the second taggant are each selected from the group consisting of terbium (III) stearate, samarium (III) stearate, cobalt (II) stearate, manganese (II) stearate, terbium (III) oleate, samarium (III) oleate, cobalt (II) oleate, or manganese (II) oleate.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure.

Other changes, substitutions, and alterations are also possible without departing from the spirit and scope of the present disclosure.

What is claimed is:

1. A method of quantifying zonal flow in a multi-lateral well formed in a subterranean formation, the method comprising:

flowing a first produced fluid comprising hydrocarbon from the subterranean formation via a first lateral in a wellbore of the multi-lateral well through a first valve into a production tubing in the wellbore;

flowing a second produced fluid comprising hydrocarbon from the subterranean formation via a second lateral in the wellbore through a second valve into the production tubing;

flowing a first taggant through a first dosing tubing in the wellbore to the first produced fluid in the first lateral to mix with the first produced fluid prior to the first produced fluid flowing through the first valve into the production tubing;

flowing a second taggant through a second dosing tubing in the wellbore to the second produced fluid in the second lateral to mix with the second produced fluid prior to the second produced fluid flowing through the second valve into the production tubing, wherein the first taggant and the second taggant are different from each other, wherein the first taggant and the second taggant are oil-soluble and each comprises a metal complexed with an oil-soluble ligand;

flowing a produced stream comprising the first produced fluid and the second produced fluid uphole through the production tubing and discharging the produced stream from the wellbore;

shutting off the first taggant and the second taggant flowed to the first produced fluid and the second produced fluid, respectively, resulting in respective transients in concentrations of the first taggant and the second taggant flowed with the produced stream;

measuring concentrations of the first taggant and the second taggant in the respective transients in the produced stream; and determining an influx rate of the first produced fluid and an influx rate of the second produced fluid from the first lateral and from the second lateral, respectively, based on the measured concentrations of the first taggant and the second taggant in the respective transients in the produced stream, wherein production of fluid from the multi-lateral well proceeds without ceasing throughout the method.

2. The method of claim 1, wherein measuring the amount of the first taggant and the amount of the second taggant in the produced stream comprises:

exposing the produced stream to an X-ray, causing the first taggant and the second taggant to fluoresce;

measuring a fluorescence of the first taggant and a fluorescence of the second taggant; and determining the amount of the first taggant and the amount of the second taggant in the produced stream based on the measured fluorescence of the first taggant and the measured fluorescence of the second taggant, respectively.

3. The method of claim 2, comprising determining an amount of the first produced fluid in the produced stream and an amount of second produced fluid in the produced stream based on the determined amount of the first taggant and the determined amount of the second taggant, respectively, in the produced stream.

4. The method of claim 3, wherein:

the first taggant is flowed through the first dosing tubing with a first carrier fluid;

the first taggant has a concentration in a range of from about 10,000 parts per million (ppm) to 100,000 ppm in the first carrier fluid;

the second taggant is flowed through the second dosing tubing with a second carrier fluid; and the second taggant has a concentration in a range of from about 10,000 ppm to 100,000 ppm in the second carrier fluid.

5. The method of claim 4, wherein the first carrier fluid and the second carrier fluid each comprises crude oil, mineral oil, ethanol, chloroform, or any combinations thereof.

6. The method of claim 5, wherein the oil-soluble ligand of the first taggant and the second taggant is a salt of oleic acid (oleate) or stearic acid (stearate).

7. The method of claim 6, wherein the metal of the first taggant and the second taggant is a rare earth metal or a transition metal, wherein the rare earth metal is selected from the group consisting of lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), or lutetium (Lu), wherein the transition metal is selected from the group consisting of cobalt (Co), manganese (Mn), nickel (Ni), or copper (Cu).

8. The method of claim 7, wherein the first taggant and the second taggant are each selected from the group consisting of terbium (III) stearate, samarium (III) stearate, cobalt (II) stearate, manganese (II) stearate, terbium (III) oleate, samarium (III) oleate, cobalt (II) oleate, or manganese (II) oleate.

9. A method of quantifying zonal flow in a multi-lateral well formed in a subterranean formation, the method comprising:

flowing a first taggant through a first dosing tubing to a first region of a wellbore of the multi-lateral well, wherein the first region is associated with a first lateral of the multi-lateral well;

flowing a second taggant through a second dosing tubing to a second region of the wellbore, wherein the second region is associated with a second lateral of the multi-lateral well, wherein the first taggant and the second taggant are different from each other, wherein the first taggant and the second taggant are oil-soluble and each comprises a metal complexed with an oil-soluble ligand;

flowing a first produced fluid comprising the first taggant from the subterranean formation through the first lateral into a production tubing in the wellbore;

flowing a second produced fluid comprising the second taggant from the subterranean formation through the second lateral into the production tubing;

flowing a produced stream comprising the first produced fluid and the second produced fluid uphole through the production tubing and out of the wellbore;

shutting off the first taggant and the second taggant flowed to the first produced fluid and the second produced fluid, respectively, resulting in respective transients in concentrations of the first taggant and the second taggant flowed with the produced stream;

measuring concentrations of the first taggant and the second taggant in the respective transients in the produced stream; and determining an influx rate of the first produced fluid and an influx rate of the second produced fluid from the first lateral and from the second lateral, respectively, based on the measured concentrations of the first taggant and the second taggant in the respective transients in the produced stream, wherein production of fluid from the multi-lateral well proceeds without ceasing throughout the method.

10. The method of claim 9, wherein the first region comprises an intersection of the first lateral with a vertical portion of the wellbore, the second region comprises an intersection of the second lateral with the vertical portion, and the production tubing is disposed in the vertical portion.

11. The method of claim 10, wherein measuring the amount of the first taggant and the amount of the second taggant in the produced stream comprises:

exposing the produced stream to an X-ray, causing the first taggant and the second taggant to fluoresce;

measuring a fluorescence of the first taggant and a fluorescence of the second taggant; and determining the amount of the first taggant and the amount of the second taggant in the produced stream based on the measured fluorescence of the first taggant and the measured fluorescence of the second taggant, respectively.

12. The method of claim 11, comprising determining an amount of the first produced fluid in the produced stream and an amount of second produced fluid in the produced stream based on the determined amount of the first taggant and the determined amount of the second taggant, respectively, in the produced stream.

13. The method of claim 12, wherein:

the first taggant is flowed through the first dosing tubing with a first carrier fluid;

the first taggant has a concentration in a range of from about 10,000 parts per million (ppm) to 100,000 ppm in the first carrier fluid;

the second taggant is flowed through the second dosing tubing with a second carrier fluid; and the second taggant has a concentration in a range of from about 10,000 ppm to 100,000 ppm in the second carrier fluid.

14. The method of claim 13, wherein the first carrier fluid and the second carrier fluid each comprises crude oil, mineral oil, ethanol, chloroform, or any combinations thereof.

15. The method of claim 14, wherein the oil-soluble ligand of the first taggant and the second taggant is a salt of oleic acid (oleate) or stearic acid (stearate).

16. The method of claim 15, wherein the metal of the first taggant and the second taggant is a rare earth metal or a transition metal, wherein the rare earth metal is selected from the group consisting of lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb), or lutetium (Lu), wherein the transition metal is selected from the group consisting of cobalt (Co), manganese (Mn), nickel (Ni), or copper (Cu).

17. The method of claim 16, wherein the first taggant and the second taggant are each selected from the group consisting of terbium (III) stearate, samarium (III) stearate, cobalt (II) stearate, manganese (II) stearate, terbium (III) oleate, samarium (III) oleate, cobalt (II) oleate, or manganese (II) oleate.

18. A method of quantifying zonal flow in a multi-lateral well formed in a subterranean formation, the method comprising:

flowing a first taggant from the surface of the Earth through a first dosing tubing to a first region of a wellbore of the multi-lateral well, wherein the wellbore is formed through the surface into the subterranean formation, and the first region is a region of intersection of a first lateral of the multi-lateral well with a vertical portion of the wellbore;

flowing a second taggant from the surface through a second dosing tubing to a second region of the wellbore, wherein the second region is a region of intersection of a second lateral of the multi-lateral well with the vertical portion, wherein the first taggant and the second taggant are different from each other, wherein the first taggant and the second taggant are oil-soluble and each comprises a metal complexed with an oil-soluble ligand;

flowing a first produced fluid comprising the first taggant from the subterranean formation through the first lateral into a production tubing in the wellbore;

flowing a second produced fluid comprising the second taggant from the subterranean formation through the second lateral into the production tubing;

flowing a produced stream comprising the first produced fluid and the second produced fluid uphole through the production tubing and out of the wellbore;

shutting off the first taggant and the second taggant flowed to the first produced fluid and the second produced fluid, respectively, resulting in respective transients in concentrations of the first taggant and the second taggant flowed with the produced stream;

exposing the produced stream to an X-ray, causing the respective transients in concentrations of the first taggant and the second taggant to fluoresce;

measuring a fluorescence of the first taggant and a fluorescence of the second taggant;

determining concentrations of the first taggant and the second taggant in the respective transients in the produced stream based on the measured fluorescence of the first taggant and the measured fluorescence of the second taggant, respectively; and determining an influx rate of the first produced fluid and an influx rate of the second produced fluid from the first lateral and from the second lateral, respectively, based on the determined concentrations of the first taggant and the second taggant in the respective transients in the produced stream, wherein production of fluid from the multi-lateral well proceeds without ceasing throughout the method.

19. The method of claim 18, comprising determining an amount of the first produced fluid in the produced stream and an amount of the second produced fluid in the produced stream based on the determined amount of the first taggant and the determined amount of the second taggant, respectively, in the produced stream.

20. The method of claim 19, wherein:

the first taggant is flowed through the first dosing tubing with a first carrier fluid comprising crude oil, mineral oil, ethanol, chloroform, or any combinations thereof;

the first taggant has a concentration in a range of from about 10,000 parts per million (ppm) to 100,000 ppm in the first carrier fluid;

the second taggant is flowed through the second dosing tubing with a second carrier fluid comprising crude oil, mineral oil, ethanol, chloroform, or any combinations thereof;

the second taggant has a concentration in a range of from about 10,000 ppm to 100,000 ppm in the second carrier fluid; and the first taggant and the second taggant are each selected from the group consisting of terbium (III) stearate, samarium (III) stearate, cobalt (II) stearate, manganese (II) stearate, terbium (III) oleate, samarium (III) oleate, cobalt (II) oleate, or manganese (II) oleate.

* * * * *